US011141028B2

(12) United States Patent
Kamenstein et al.

(10) Patent No.: US 11,141,028 B2
(45) Date of Patent: Oct. 12, 2021

(54) ADJUSTABLE TENSION AND SPIN CONTROL CAP FOR ROLL DISPENSERS

(71) Applicant: Peter Kamenstein, North Salem, NY (US)

(72) Inventors: Peter Kamenstein, North Salem, NY (US); Kanjana Chaiwatanachai, Bangkok (TH); Kaisern Chen, Bangkok (TH)

(73) Assignee: Peter Kamenstein, North Salem, NY (US)

( * ) Notice: Subject to any disclaimer, the term of this patent is extended or adjusted under 35 U.S.C. 154(b) by 98 days.

(21) Appl. No.: 16/678,853

(22) Filed: Nov. 8, 2019

(65) Prior Publication Data

US 2020/0146518 A1 May 14, 2020

Related U.S. Application Data

(60) Provisional application No. 62/758,102, filed on Nov. 9, 2018.

(51) Int. Cl.
*A47K 10/38* (2006.01)
*A47K 10/32* (2006.01)

(52) U.S. Cl.
CPC ..... *A47K 10/38* (2013.01); *A47K 2010/3233* (2013.01); *A47K 2010/3863* (2013.01)

(58) Field of Classification Search
CPC ..... A47K 10/38; A47K 2010/3863; A47K 2010/3233; A47K 10/3836
See application file for complete search history.

(56) References Cited

U.S. PATENT DOCUMENTS 4,738,385 A * 4/1988 Bell ..... A47K 10/40 225/106
4,792,102 A * 12/1988 Olson ..... A47K 10/38 242/423.2
5,755,397 A * 5/1998 Freese ..... A47K 10/38 242/423.1
7,124,976 B1 * 10/2006 DeVincenzo ..... A47K 10/3836 242/423.1
7,909,284 B2 * 3/2011 Burns ..... B65H 49/26 242/597.5

* cited by examiner

*Primary Examiner* — William A. Rivera
(74) *Attorney, Agent, or Firm* — Cowan, Liebowitz & Latman, P.C.; Mark Montague

(57) ABSTRACT

An improved cap for a paper dispenser with an adjustable tension control and a tension grip having several ribs and a spring housing for accommodating a tension spring within the housing, a first and second circular end rings on the two end tips of the tension grip, a tension rod attached to the first circular end, a spring base having a threaded shaft, a tension adjustment dial, having a ribbed outer surface, and a plurality of braking blades, extending in a longitudinal direction to the plane of the tension adjustment dial and coming into frictional contact with an inner surface of the tension grip or the second end ring, for controlling the rotational speed and dispensing of the toilet paper.

22 Claims, 43 Drawing Sheets

160

160

150

170

B

B

180

145
FINIAL

SECTION P-P

140
FINIAL GRIP

147

RACE TOP

137
COLUMN

120b

LOCKING COLLAR /PP

SECTION L-L

170b
SPRING BASE

150
RACE BASE/ PP

187

WEIGHT

SECTION S-S
SCALE 1 : 2

190

BASE COVER / PP

192
BASE SHELL

SECTION M-M
SCALE 1 : 2

180
ENSION ADJUSTMENT DIAL

197

NON-SKIP PAD

168
SCREW COVER

200

SECTION A-A
SCALE 1 : 1

235 tension grip

SECTION B-B

237 spring housing

220 tension core

SECTION D-D 240
end lock

SECTION E-E

270
Spring base

FIG. 33A
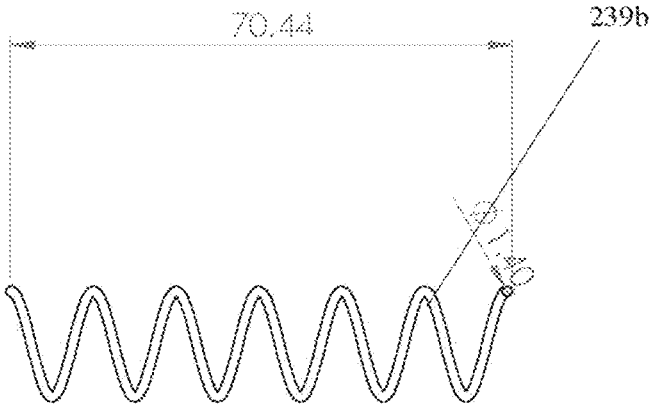
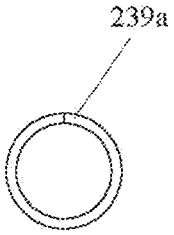
FIG. 33B
239
SS spring 280
tension adjusment dial

290 non skip end/ synthetic rubber

ADJUSTABLE TENSION AND SPIN CONTROL CAP FOR ROLL DISPENSERS

The present application claims priority of a provisional patent application No. 62/758,102, filed on Nov. 9, 2018 and entitled "Adjustable Tension Control Cap for Roll Dispensers.

FIELD OF THE INVENTION

The present invention relates to an improved tension control cap for use with paper, plastic, foil, tape other dispensers that utilize a rotating roll of varying width and continuous sheets dispensed from a rotating base. In particular, the present invention relates to a cap that controls the tension and rotational speed of a rolling base (or holder) of a dispenser for paper, plastic, foil, tape or other items that come as continuous sheets or rolls of different length and width, rotationally dispensed from the rotating dispenser base.

SUMMARY OF THE INVENTION

Many household items are supplied in a continuous sheet, rolled into a roll, which is placed on a rotating dispenser. For example, paper towels, plastic and foil, toilet paper, tape, etc. are supplied as continuous or attached sheets on a rotating dispenser. Dispensing of these rolled materials is typically done by a variety of different dispensing devices (dispensers) that mount the roll (rolled material), with a hollow center on a dispenser dowel or a rod, which allows the unraveling (or rotation) of the rolled material to the desired length and then separating (or tearing) the unraveled part from the remaining roll.

When a user unravels and spins the roll, it might be unraveled with excessive speed, causing excessive unraveling of the rolled product, and resulting in unnecessary waste of the rolled product.

Furthermore, different rolls may have variances and differences in a diameter of the inner opening, or may have different level of rigidity of the inner surface, causing different rolls to unravel at different speeds.

Another problem involves the thicker rolls that may be initially held more tightly by the dispenser. However, when there is less material on the roll, they become more loosely held and unravel faster.

One problem with the many known dispensers is that they do not have an easy and effective way to set and control tension of the rolled material and the unraveling speed during dispensing. Thus, they can't prevent excessive unraveling and unnecessary waste of the rolled product. Furthermore, most dispensers do not allow the excess unrolled materials to be rolled back, which leads many users to leave the unraveled material loosely hanging or bunched up on the roll (in an attempt to save the excess material). This interferes with the operation of many dispensers and is also highly undesirable in the dispensers utilized in public places.

The dispensers that allow users to control the speed of rotation during dispensing operation have other problems. They have a more complicated structure and require purchase of a full new dispenser, at a much higher price than the typically inexpensive dispensers that are 0used in most public facilities.

For many consumers, the purchase of a roll with a mechanism that prevents excessive unraveling requires an additional, and often more expensive, purchase. Moreover, an individual consumer might not be able to use the mechanism with his or her already purchased dispensers, causing additional waste of the already purchased items (that will no longer be in use). The incompatibility with the existing dispensers also prevents their acceptance by a wider consumer market.

The present invention addressed the above problems by providing a simple, efficient and inexpensive adjustable tension control cap and a method for its use and installation with many existing dispensers that in common use today in a wide consumer market.

By controlling the frictional tension between braking blades of a cap base and a ribbed inner surface of a rotor, the user can vary and adjust the tension and unraveling speed in accordance with at least one embodiment of the present invention.

The adjustable tension control cap causes the dispenser to hold more tightly the roll and also control the unraveling (spinning speed) of the dispenser. Thus, it allows the user to control and adjust both the level of tension with which the roll is held in place by the dispenser, and also vary the rotational force and speed of the roll when it unravels.

One feature of the present invention is a cap with a tension adjustment control comprising a rotor having a threaded portion on an inner bottom surface, a spring base including a plurality of braking blades that come into frictional contact with a surface of a rotor upon rotation of the rotor and operation of the tension adjustment dial, where the contact of the braking blades reduced rotational speed of the dispenser. In some embodiments, the extent of frictional contact of the braking blades with a ribbed inner part of the contacting rotor surface is controlled by a tension adjustment dial. In other embodiments, the plurality of braking blades come into frictional contact with the rotor surface in response to at least one electromagnetic signal.

In at least one embodiment, the braking blades of the cap extend longitudinally to a plane of rotation of the rotor and increase the frictional contact with a ribbed inner surface of the rotor in response to rotation of the tension adjustment dial. In other embodiments, the plurality of braking blades extend laterally to a plane of rotation of the rotor and increasing the frictional contact with the inner surface of the rotor in response to rotation of the tension adjustment dial.

In at least one embodiment, the braking blades of the cap extend longitudinally to a plane of rotation of the rotor and increase the frictional contact with a ribbed inner surface of the rotor in response to rotation of the tension adjustment dial. In other embodiments, the plurality of braking blades extend laterally to a plane of rotation of the rotor and increasing the frictional contact with the inner surface of the rotor in response to rotation of the tension adjustment dial.

The adjustable tension control cap of the present invention may be utilized in a number of different dispenser devices. In particular, it may be used in a paper or other product dispensing device comprising a rotor having a threaded portion on an inner bottom surface, a spring base including a threaded shaft and a plurality of braking blades that come into frictional contact with a surface of the rotor upon rotation of the rotor, a tension adjustment dial for controlling the extent of frictional contact of said plurality of braking blades with a ribbed inner part of the contacting rotor surface, a limit cap having a generally tubular shape and constructed to limit the longitudinal movement of the tension adjustment dial and a corresponding movement of the braking blades, a plurality of tension rod wires for holding a dispensed product, a solid rod extending through a central opening of the rotor, a finial grip for holding one tip of the solid rod, and a finial grip cover, covering the finial grip. The braking blades of the cap used in such a dispenser extend and increase the frictional contact with a surface of the rotor in response to rotation of the tension adjustment dial, and thereby control the speed of rotation of the rotor and dispensing of the product by the dispenser.

The dispenser in accordance with at east one embodiment may also utilize a race top having a central opening for accommodating the solid rod and having a plurality of cavities for accommodating the tension rod wires. It may also include a base shell fitting over a base cover, having a circular opening in the center, and fitting over the tension adjustment dial, and a weighted base part above or below the tension adjustment wheel, covered by the base shell.

In at least one embodiment, the adjustable tension control cap of the present invention may be utilized as part of a toilet paper dispenser comprising a tension grip having a plurality of ribs and a spring housing for accommodating a tension spring within the housing, a first and second circular end rings on the two end tips of the tension grip, a tension rod attached to the first circular end, a spring base having a threaded shaft, a tension adjustment dial, having a ribbed outer surface, and a plurality of braking blades, extending in a longitudinal direction to the plane of the tension adjustment dial and coming into frictional contact with an inner surface of the tension grip or the second end ring, for controlling the rotational speed of the dispenser and dispensing of the toilet paper.

In at least one embodiment, the plurality of braking blades extend longitudinally to the plane of tension adjustment dial, and increase the frictional contact with the inner surface of the tension grip or the second ring in response to rotation of the tension adjustment dial and a movement of the tension adjustment dial along the threaded shaft of the spring base.

The toilet paper dispenser may also include a dial display for the tension adjustment dial, an end lock for fixedly attaching to the spring base, and a pair of plastic caps, having a flexible and expandable inner part for fixedly covering the tip of the tension rod on one end and the end lock on the other end.

BRIEF DESCRIPTION OF THE DRAWINGS

The above and other features and aspects of the present invention will become more apparent upon reading the following detailed description in conjunction with the accompanying drawings, in which:

FIGS. 33A-B illustrate structure of a spring for the spring base component of a toilet paper dispenser that utilizes an adjustable tension control cap in accordance with at least one embodiment.

DETAILED DESCRIPTION

The construction and operation of the invention is explained with reference to at least one embodiment shown in FIGS. 1-35.

While some embodiments described herein and depicted in corresponding figures show use of the adjustable tension control cap in connection with paper rolls and toilet paper rolls, the use of the adjustable tension control cap is not intended to be limited to any specific type of a dispenser. A person skilled in the art would understand and apply the described cap to other types of dispensers and to any rolls of different length, width, thickness and different types of dispensing materials (not limited to paper rolls).

Figure 1A:
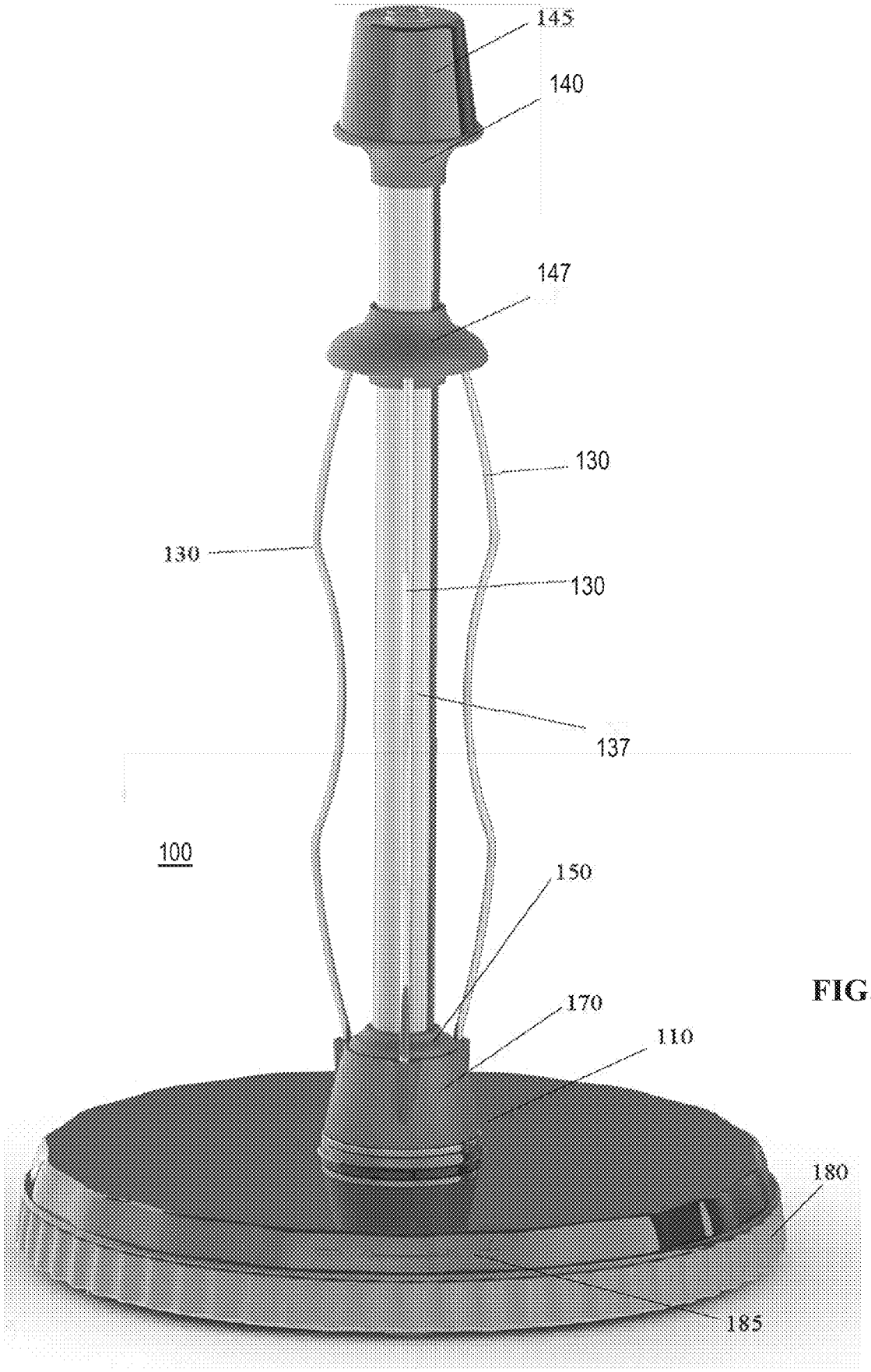
FIG. 1A illustrates a side view of a paper roll dispenser that utilizes an adjustable tension control cap in accordance with at least one embodiment.
Figure 1B:
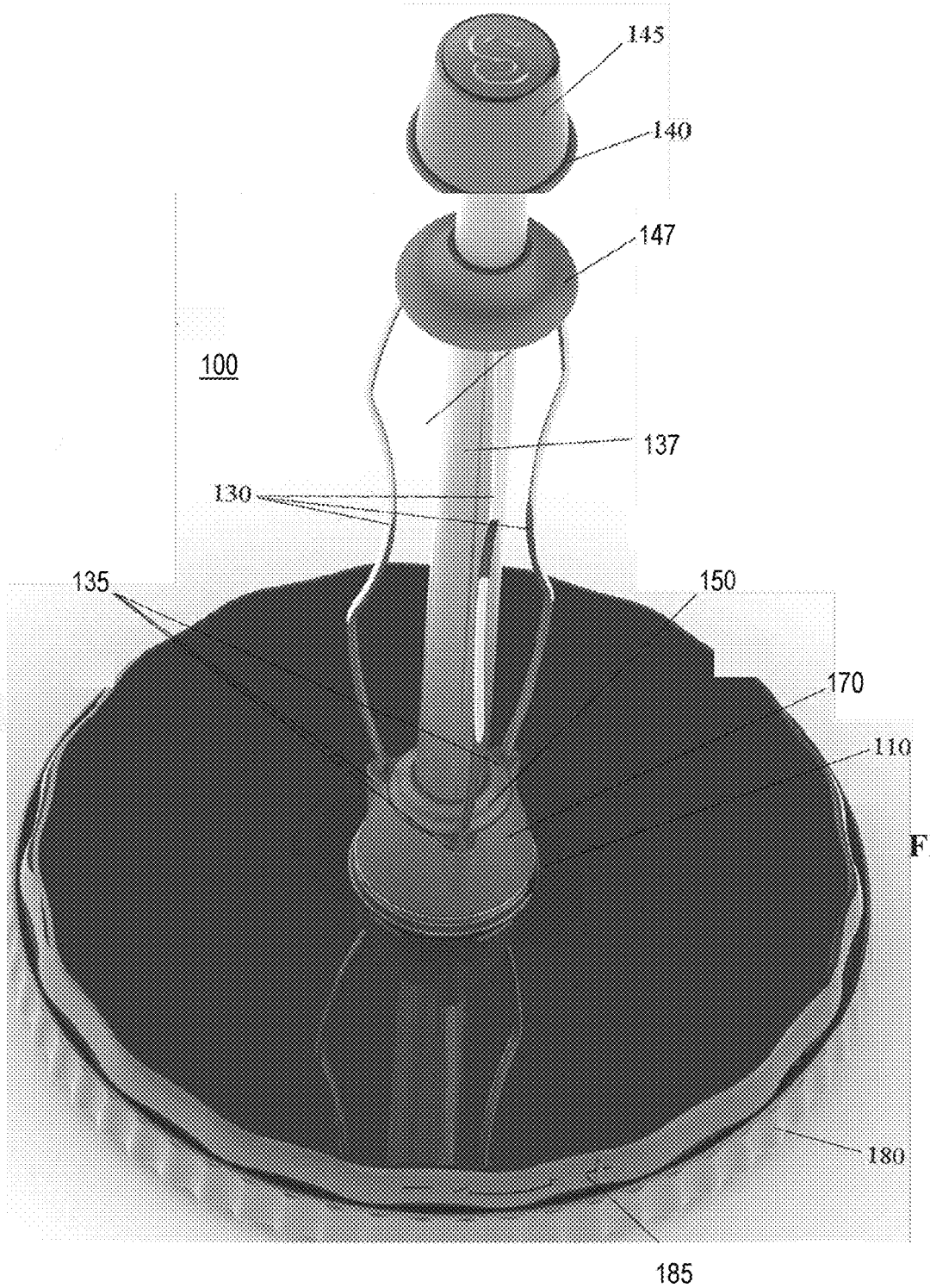
FIG. 1B illustrates an elevated side view of a paper roll dispenser that utilizes an adjustable tension control cap in accordance with at least one embodiment.
Figure 1C:
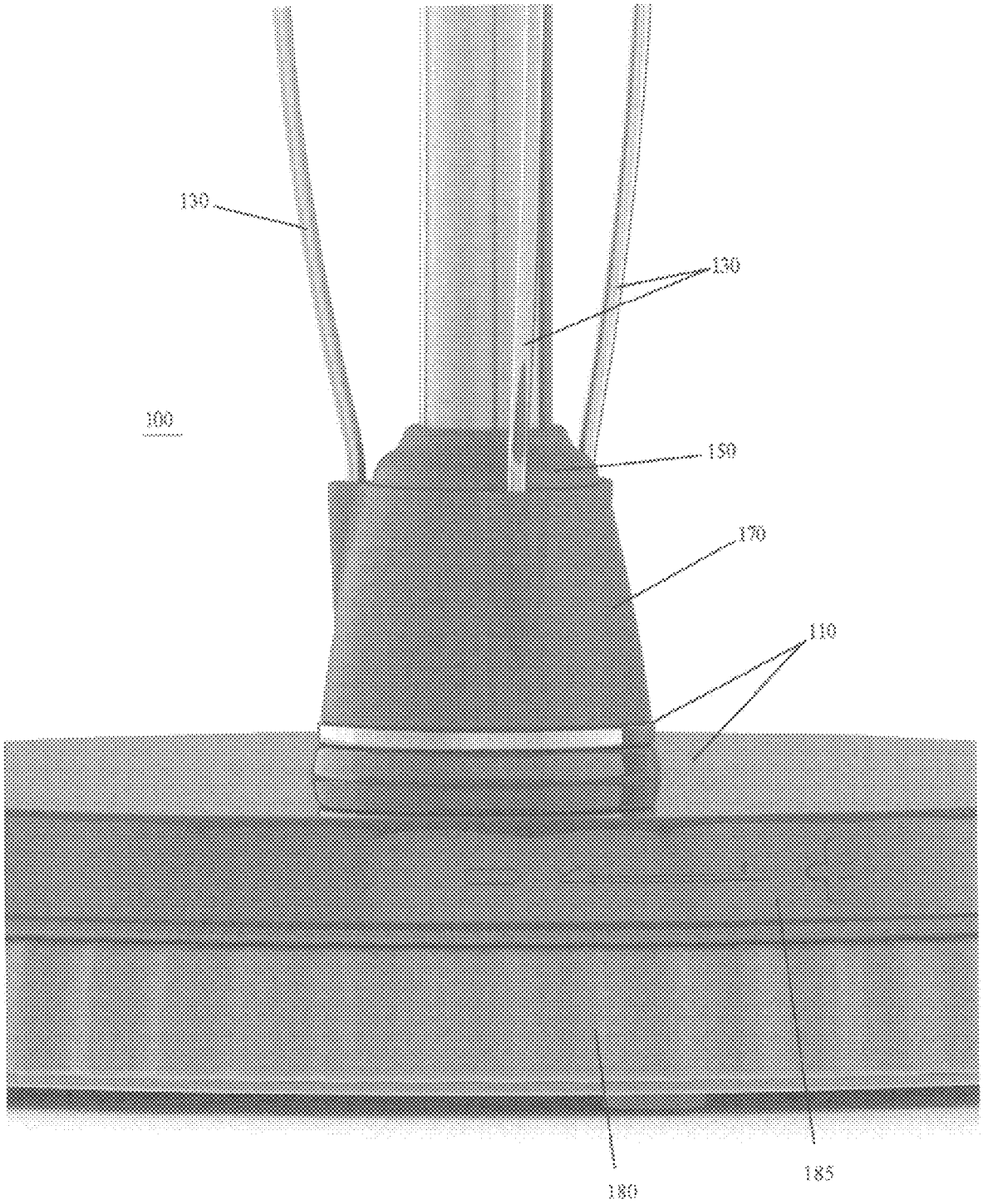
FIG. 1C illustrates an enlarged view of an adjustable tension control cap utilized with a paper roll dispenser in accordance with at least one embodiment.
Figure 12A:
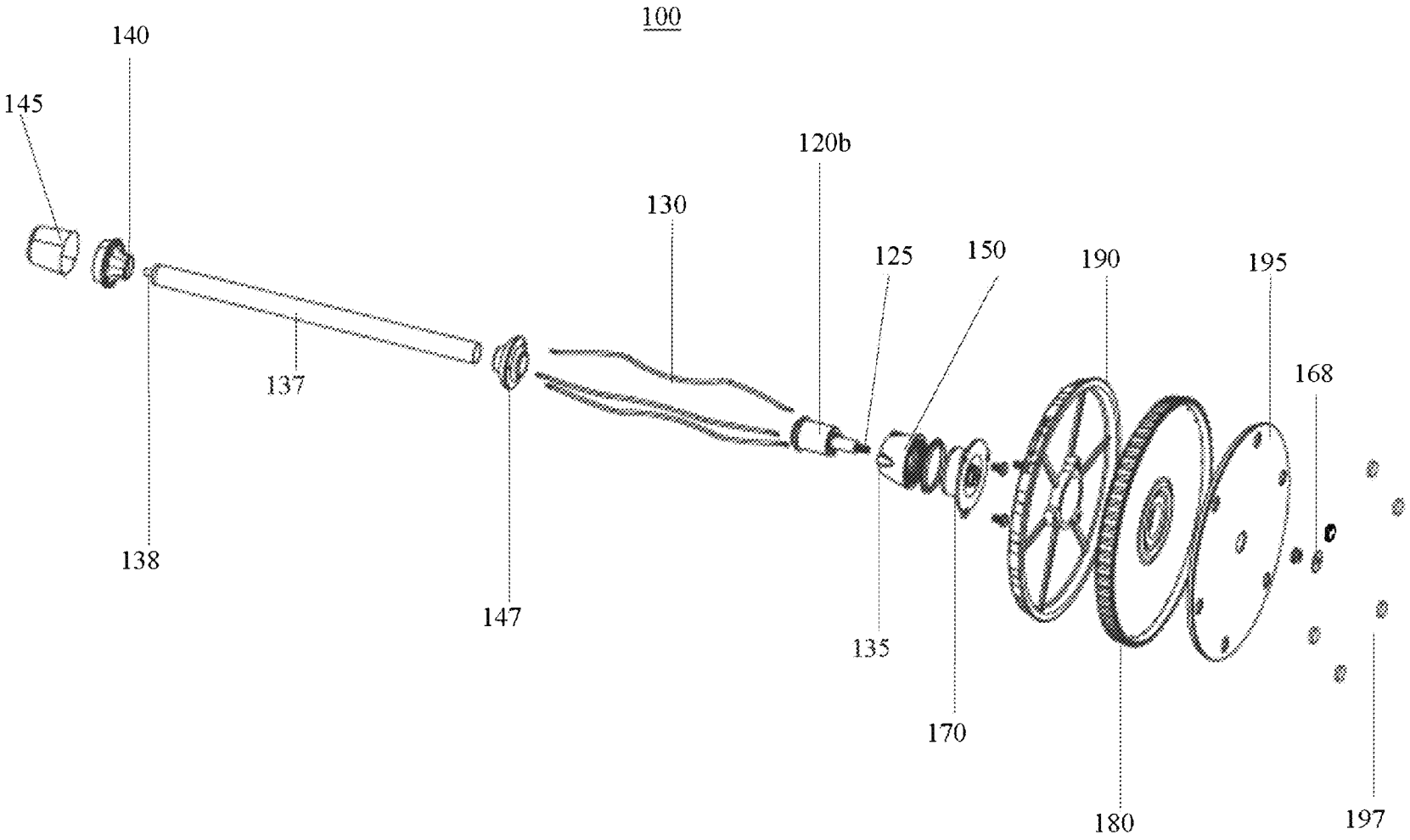
FIGS. 12A-B illustrate an exploded side view of the components of a paper roll dispenser that utilizes an adjustable tension control cap in accordance with at least one embodiment.
Figure 12B:
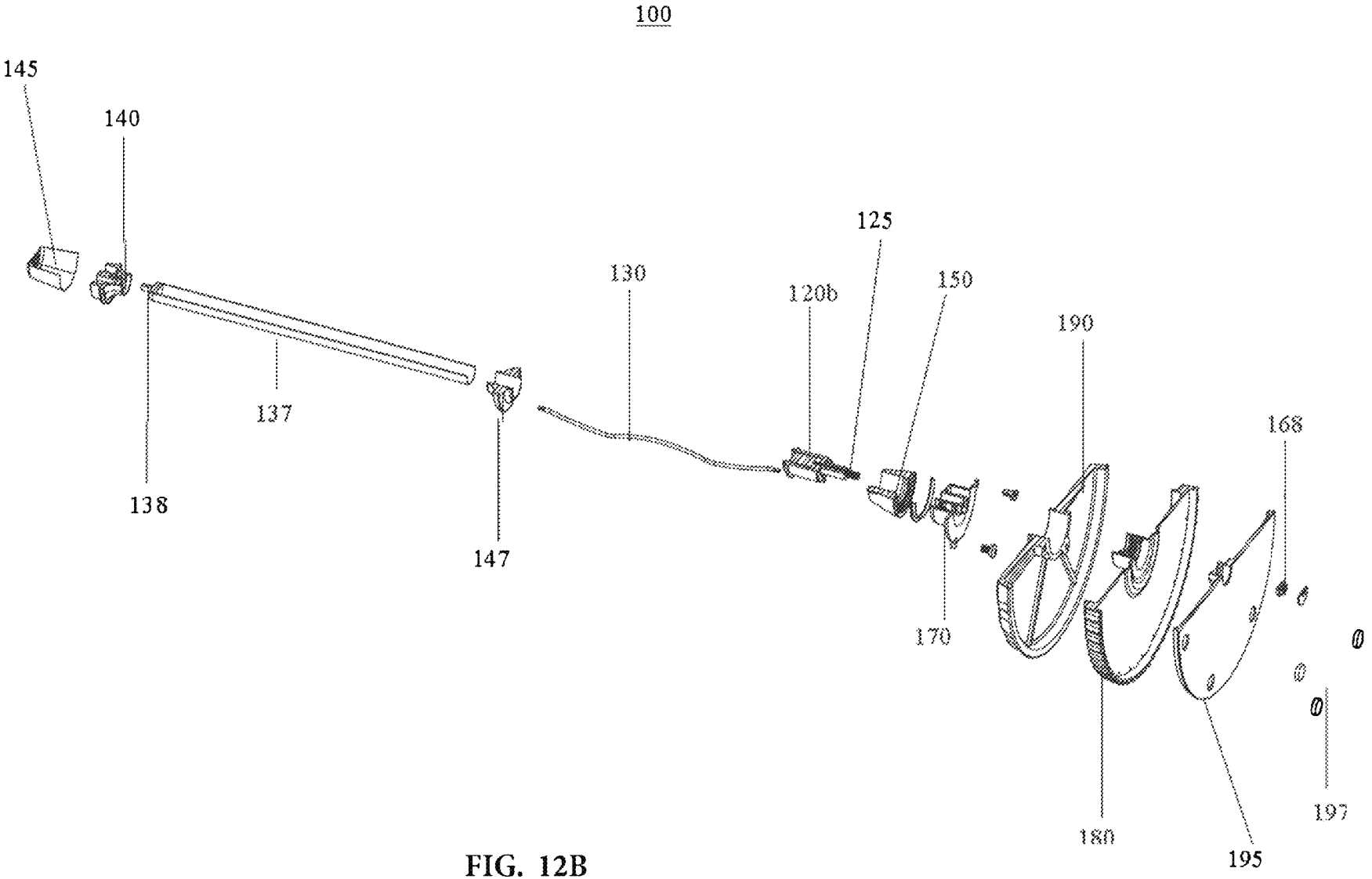

FIGS. 1A and 1B illustrate a side view and a top side views of a paper towel dispenser 100 that utilizes an adjustable tension control cap 110. FIG. 1C illustrates an enlarged view of the tension control cap 110 utilized with a paper roll dispenser in accordance with at least one embodiment. FIGS. 12A and 12B show the structure and connection of the adjustable tension control cap with other components of a paper roll dispenser in accordance with at least one embodiment.

As illustrated in FIGS. 2-4 and 12A-B and 1A-C, the adjustable tension control cap 110 has a rotor 150 (also described herein as a race base), and a spring base 170, which accommodates multiple tension rod wires 130 that are used with a column or solid rod part 137, creating a tension rod construction that holds a roll of paper or some other material. The tension wires 130 engage and hold the rolled material with a hollow tubular opening in the center by a pressure force exerted onto the inner surface of the roll (when the roll is inserted through the opening and slidably pushed downward over the dispenser column and the tension wires).

Figure 2:
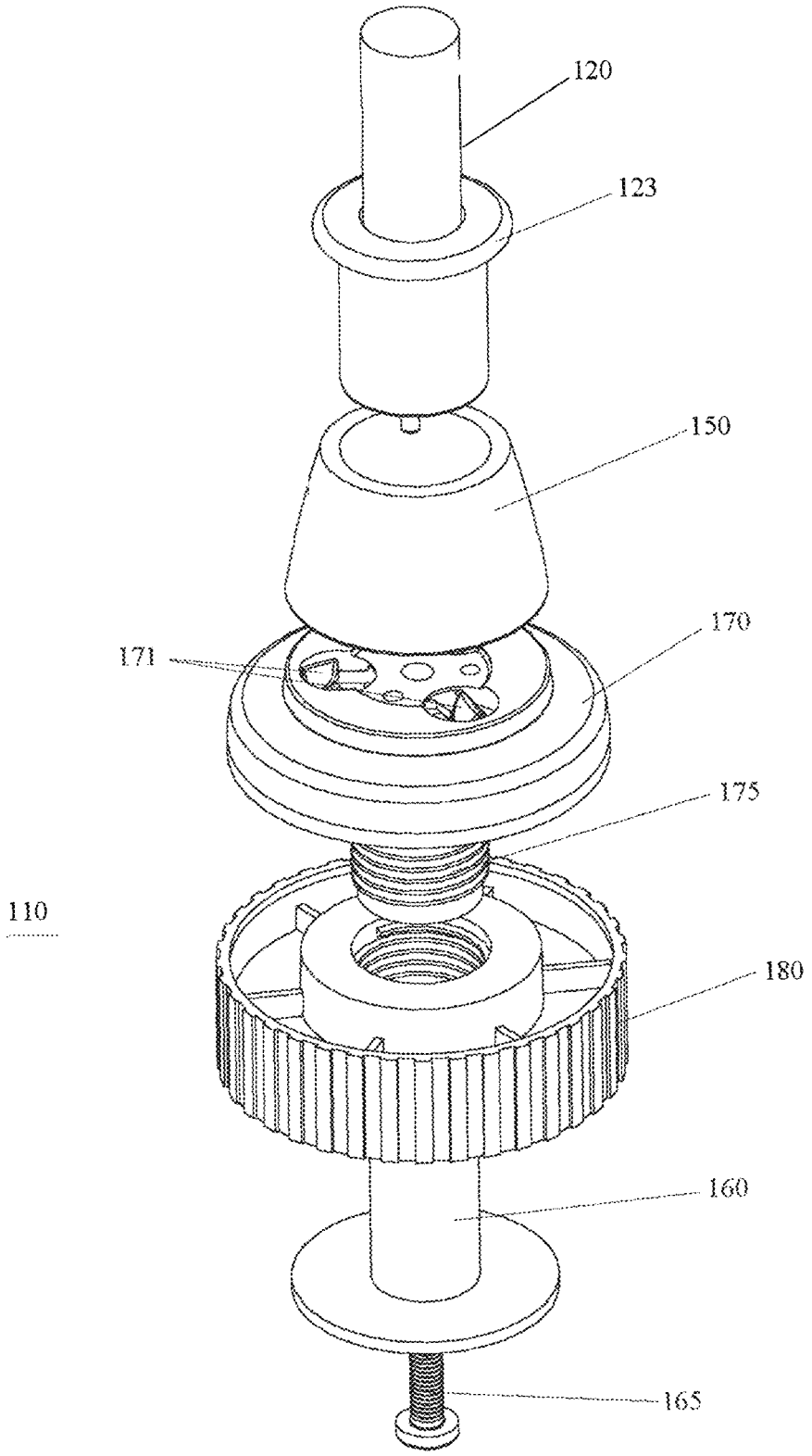
FIG. 2 illustrates a side view of the components of an adjustable tension control cap in accordance with at least one embodiment.
Figures 3A, 3B:
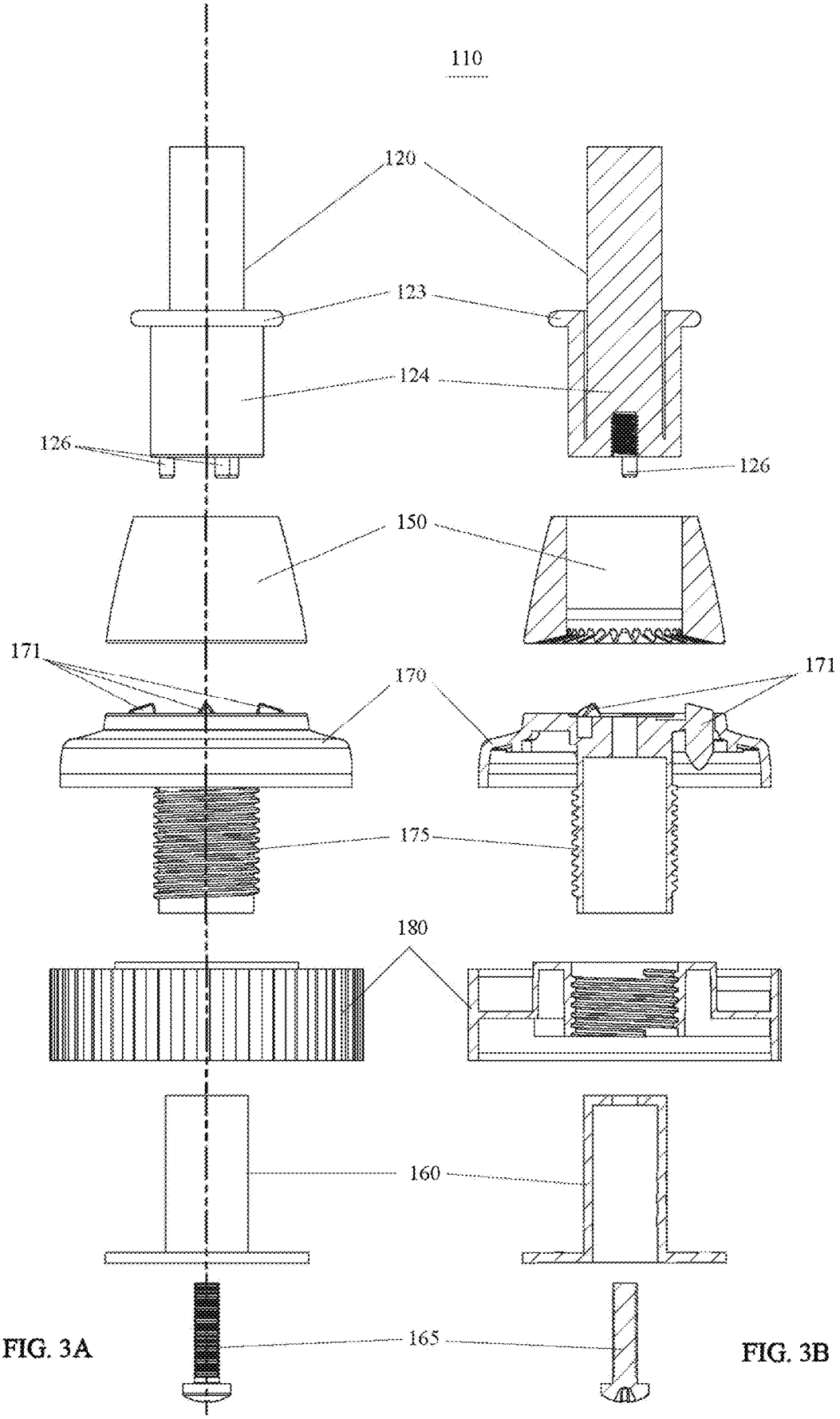
FIGS. 3A-B illustrate inner and outer structure and arrangement of the components of an adjustable tension control cap in accordance with at least one embodiment.
Figure 4:
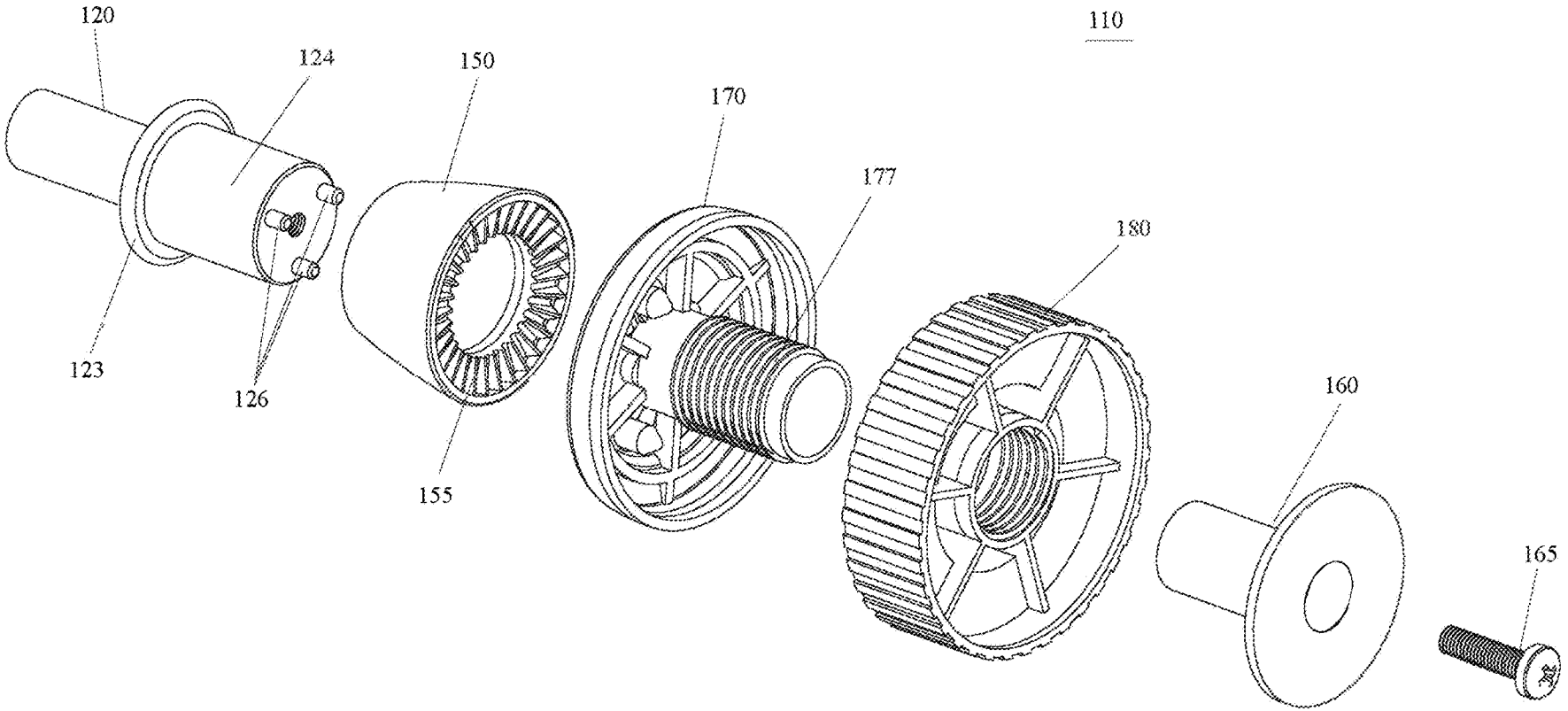
FIG. 4 illustrates a side exploded view of an arrangement of the components of an adjustable tension control cap in accordance with at least one embodiment.
Figure 5A:
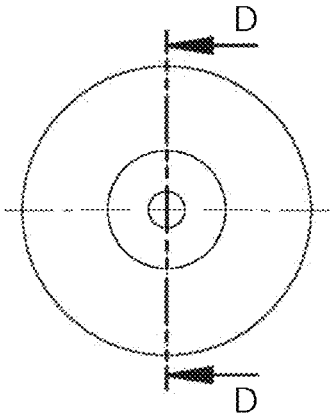
FIGS. 5A-D illustrate inner and outer structure of a limit cap component of an adjustable tension control cap in accordance with at least one embodiment.
Figure 5B:
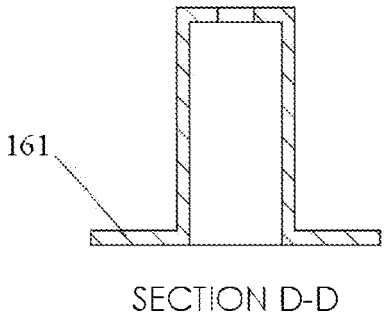
Figure 5C:
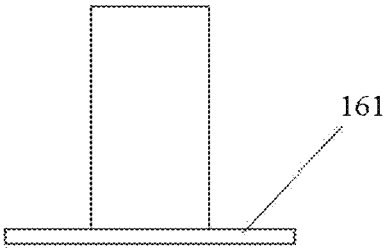
Figure 5D:
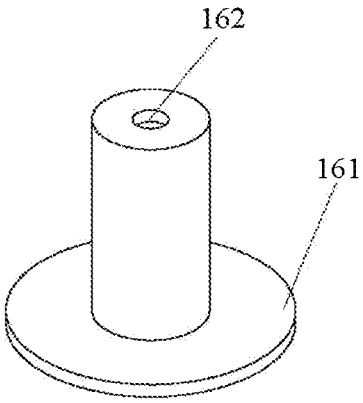
Figure 6A:
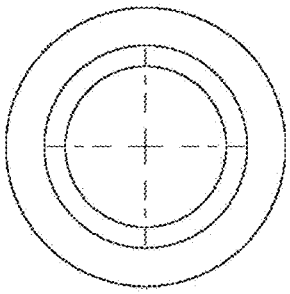
FIGS. 6A-E illustrate inner and outer structure of a rotor component of an adjustable tension control cap in accordance with at least one embodiment.
Figure 6B:
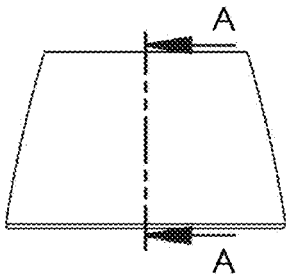
Figure 6C:
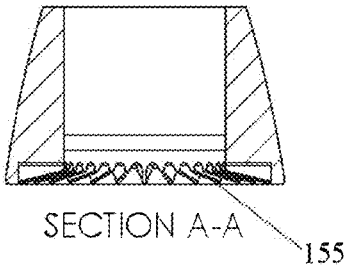
Figure 6D:
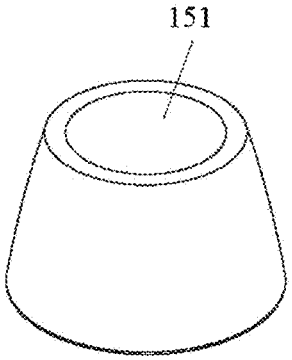
Figure 6E:
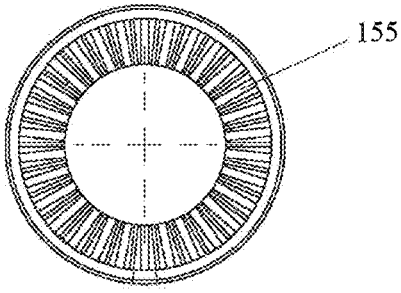
Figure 7A:
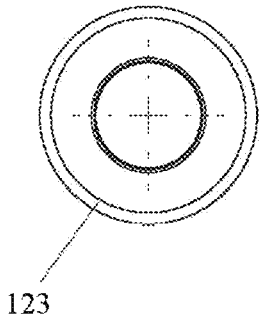
FIGS. 7A-D illustrate structure of a rotor lock component of an adjustable tension control cap in accordance with at least one embodiment.
Figure 7B:
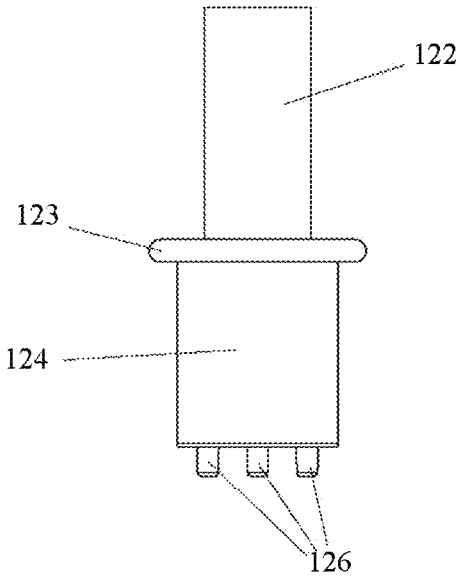
Figure 7C:
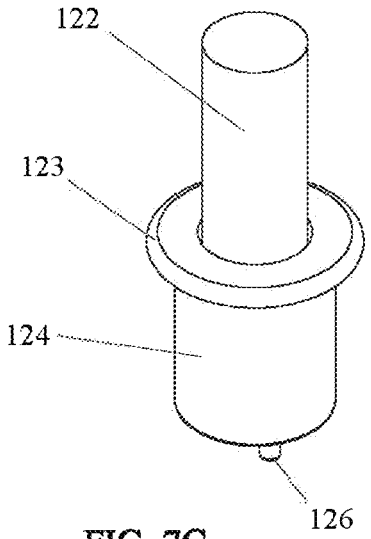
Figure 7D:
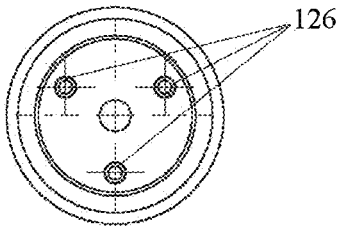
Figure 8A:
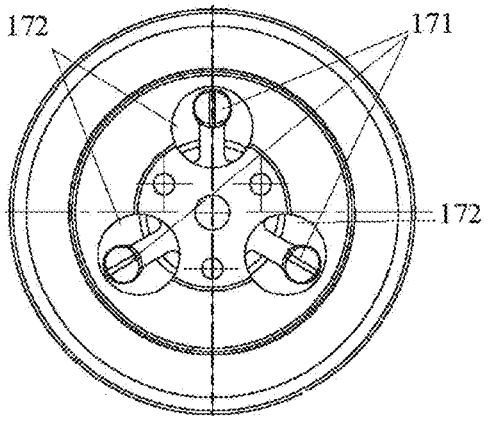
FIGS. 8A-E illustrate inner and outer structure of a spring base component of an adjustable tension control cap in accordance with at least one embodiment.
Figure 8B:
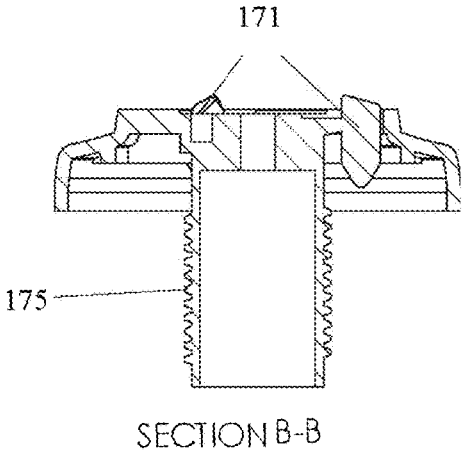
Figure 8C:
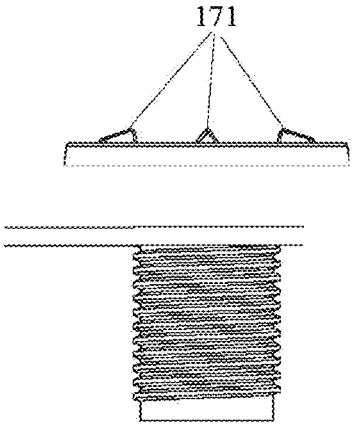
Figure 8D:
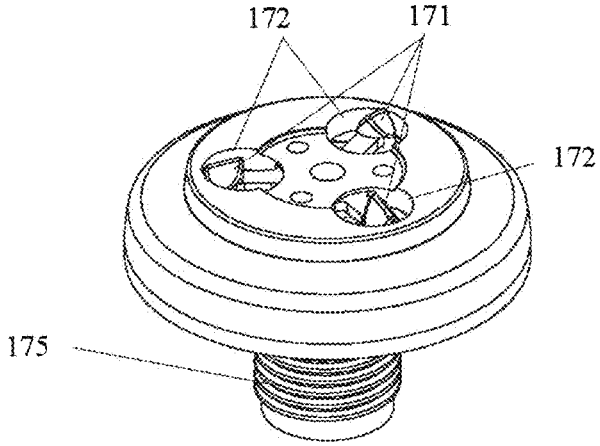
Figure 8E:
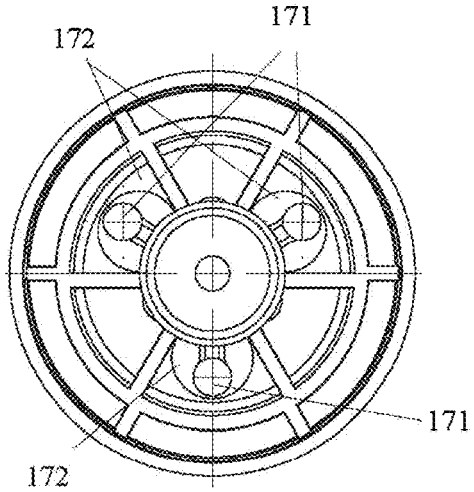

As further illustrated in FIGS. 2-4, the spring base 170 also has multiple braking blades 171, which frictionally cooperate with the rotor 150 to control and adjust the tension and rotational speed of the dispenser 100 when it dispenses the rolled paper (or some other material). The tension control cap 110 is mounted on a locking shaft 120, which connects on one end to the column or solid rod part 137.

FIGS. 7A-D illustrate the inner and outer structure of a locking shaft 120 in accordance with at least one embodiment. It includes an upper part 122 that connects to a solid rod part 137 and a lower part 124, having a wider skirt 123 and locking pins 126 on the bottom surface. The locking shaft is configured to connect and remain attached to the other parts of the adjustable tension control cap 110. The locking shaft 120 may also have a threaded opening in the center, to accommodate a screw 165 in order to hold the components of the adjustable tension control cap 110 in place.

Figure 26A:
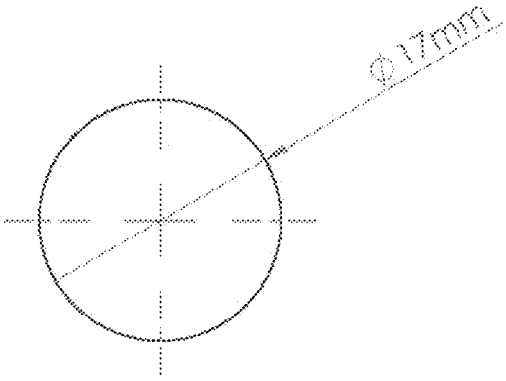
FIGS. 26A-C illustrate structure of a screw cover component of a paper roll dispenser that utilizes an adjustable tension control cap in accordance with at least one embodiment.
Figure 26B:
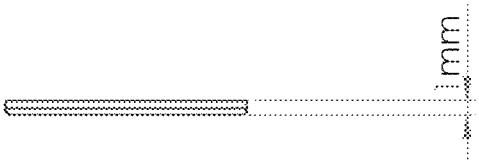
Figure 26C:
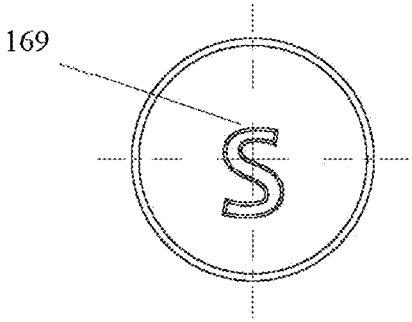

An alternative embodiment of a locking shaft 120*b*, in accordance with another embodiment of the invention, is depicted in FIGS. 18A-D. In the alternative embodiment, the locking shaft 120*b* has a wider skirt part 123*b* at the top, which connects it to the solid column (or rod) part 137. On the bottom surface, the locking shaft 120*b* has a connecting screw 125, which connects it to other components of the adjustable tension control cap 110. The bottom part of the screw 125 is covered by a screw cover 168, whose structure is shown in FIGS. 26A-C. The top surface of the screw may have a logo 169 or a name, which can be inscribed, printed, carved or otherwise shown, indicating the brand name and origin.

FIGS. 8A-E illustrate the inner and outer structure of a spring base 170 component of an adjustable tension control cap in accordance with at least one embodiment of the invention. The spring base 170 contains multiple braking blades 171, which may be molded as part of the spring base 170. Alternatively, the braking blades may be attached to the spring base 170 at the braking blade location points 172.

In accordance with at least one embodiment, the braking blades 171 extend in the longitudinal direction (up or down) when a rotational force is applied by a user through the rotation of a tension adjustment dial 180 of the tension control cap. The braking blades 171 frictionally engage a ribbed inner surface 155 of the rotor 150, constructed to create and increase friction against the braking blades 171.

In another embodiment, the braking blades 171 may extending laterally, in response to the movement of the tension dial 180 by the user, and increase friction against the inner or another surface of the rotor 150.

The user may choose to rotate the tension adjustment dial 180 in a direction of increased tension, as may be indicated on a dial display 185, or, alternatively, the dispenser may receive electromagnetic signal or other types of signals causing the tension adjustment dial 180 dial to move up or down on the bottom part 175 (shown in FIGS. 2 and 3) of the spring base 170 in order to cause the increase in tension and control the rotational speed of the dispenser.

An alternative embodiment of a spring base component of an adjustable tension control cap in accordance with at least one embodiment is illustrated in FIGS. 19A-E. The spring base 170*b* has a general cylindrical shape, with multiple braking blades 171 molded to or attached to the inner part of the spring base 170 at the braking blade location points 172. Instead of a threaded shaft, the spring base 170*b* has a wider skirt 177, with multiple openings 176, each accommodating a connecting member (like a screw or s bolt) that attaches the spring base 170*b* to a base cover 190 and/or the base shell 192, covering the tension adjustment dial 180 component, a base weight 187 and the bottom base cover 195.

Referring to FIGS. 10A-E and 24A-D, as well as FIGS. 1A-C, 2, 3A-3B and 4, when a rotational force is applied by the user to a ribbed outer surface 182 of the tension adjustment dial 180 (or through an automated setting process) in a direction of the increased tension (as may be indicated on a dial display 185). the tension adjustment dial moves longitudinally, along the axis of the threaded shaft 175 and the limit cap 160.

FIGS. 10A-E illustrate the structure of a tension adjustment dial 180 in accordance with at least one embodiment. The tension adjustment dial 180 has a ribbed outer surface 182, which may be rotationally engaged and moved by the user in one direction to increase tension of the cap and slow down the rotational speed of the dispenser. The tension adjustment wheel may be rotated in the opposite direction when the user desires to decrease the tension and speed up the rotational speed during the dispensing of the rolled material.

The dial 180 has a threaded inner surface 184 that allows movement of the wheel up and down the threaded shaft 175. The limit cap 160 limits the rotation and longitudinal movement of the tension adjustment dial 180 along the threaded shaft 175 of the spring base 170.

An alternative embodiment of a tension adjustment dial 180 is shown in FIGS. 24A-D. The tension adjustment dial 180 of the embodiment shown in FIGS. 24A-D utilizes a solid construction for the wheel, with a ribbed outer surface 182 and an inner opening 184, which accommodates upward and downward movement of the tension adjustment wheel 180 on a threaded shaft or the shaft of a connecting screw.

As further illustrated in 9A-B, 8A-E and 19A-E, the upward movement of the tension adjustment dial 180 pushes upward the braking blades 171, each of which is either integrally connected to, or molded as a part of, the spring base at the corresponding attachment point 172. When the braking blades 171 are pushed upward by the upward movement of the tension adjustment dial 180, the blades 171 come into frictional contact with the ribbed inner surface 155 of the rotor 150. The force of friction between the blades and the ribbed inner surface of the rotor increases with the upward movement, and decreases with the downward movement, of the braking blades 171. The increase in friction causes reduces the spinning speed of the rotor the dispenser, preventing the excessive unraveling of the rolled material.

Figure 11A:
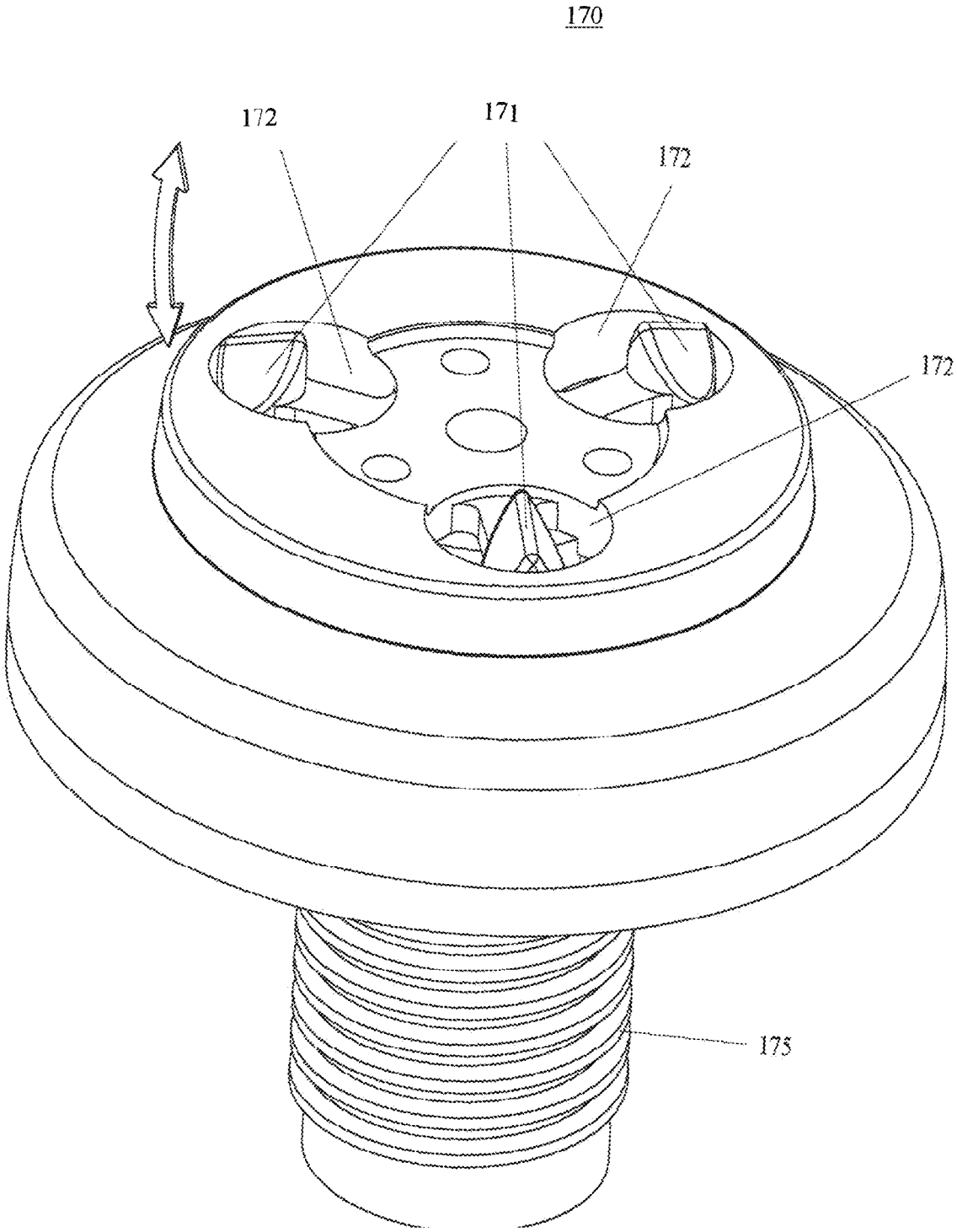
FIGS. 11A-B illustrate the directional movement of a tension adjustment dial and the direction of the movement and force exerted upon the locking blades of the spring base in accordance with at least one embodiment.
Figure 11B:
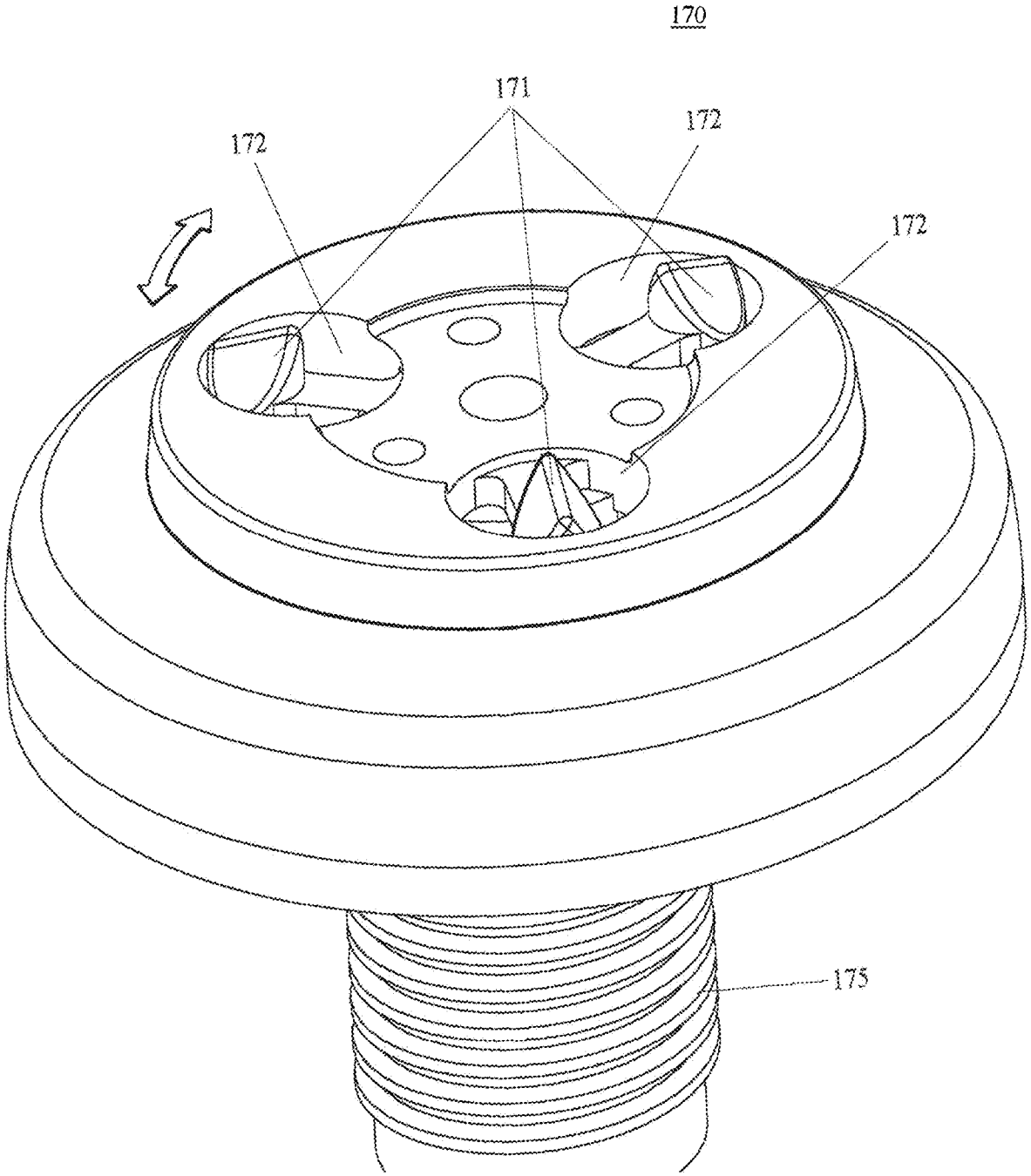

FIG. 11A illustrate the direction of a rotation of the tension adjustment dial 180 on the threaded shaft of the spring base 170, which produces the upward movement of the tension adjustment dial 180 and also cause the braking blades 171 to move upward at the braking blade location points 172, as in indicated in FIG. 11B.

This causes the roll to be more tightly held in place by the dispenser, and also controls the spinning speed during the unraveling of the dispensed product. Thus, it allows the user to control and adjust both the level of tension with which the roll is held in place, and the rotational force and speed of the roll when it unravels the rolled material. This prevents the unnecessary waste due to excessive unraveling. It also allows the user to control and adjust the tension with which the rolled product is held in place and unraveled.

The tension control and the spinning speed control may both be necessary and desired to address the variances and differences in the inner diameter or the rigidity of the inner walls of the rolled product. Also, the tension with which the roll is held by the dispenser may vary when a significant portion of the rolled product has already been unraveled. For example, a full roll may be initially be held more tightly, and unravel more slowly, but may become looser and spin faster when more of the roll product is unraveled. Thus, by controlling tension exerted by the braking blades against the inner surface of the rotor, the user can vary and adjust the tension and unraveling speed of a roll at different stages.

As part of the reverse tension adjustment process, the user rotates the tension adjustment dial 180 by spinning the ribbed outer surface 182 of the dial wheel in a direction of loosening tension and increasing the dispensing speed, as may be indicated on the dial display 185. This causes the tension adjustment wheel 180 to move down in a longitudinal direction, along the threaded shaft 175 of the spring base 170.

Figures 9A, 9B:
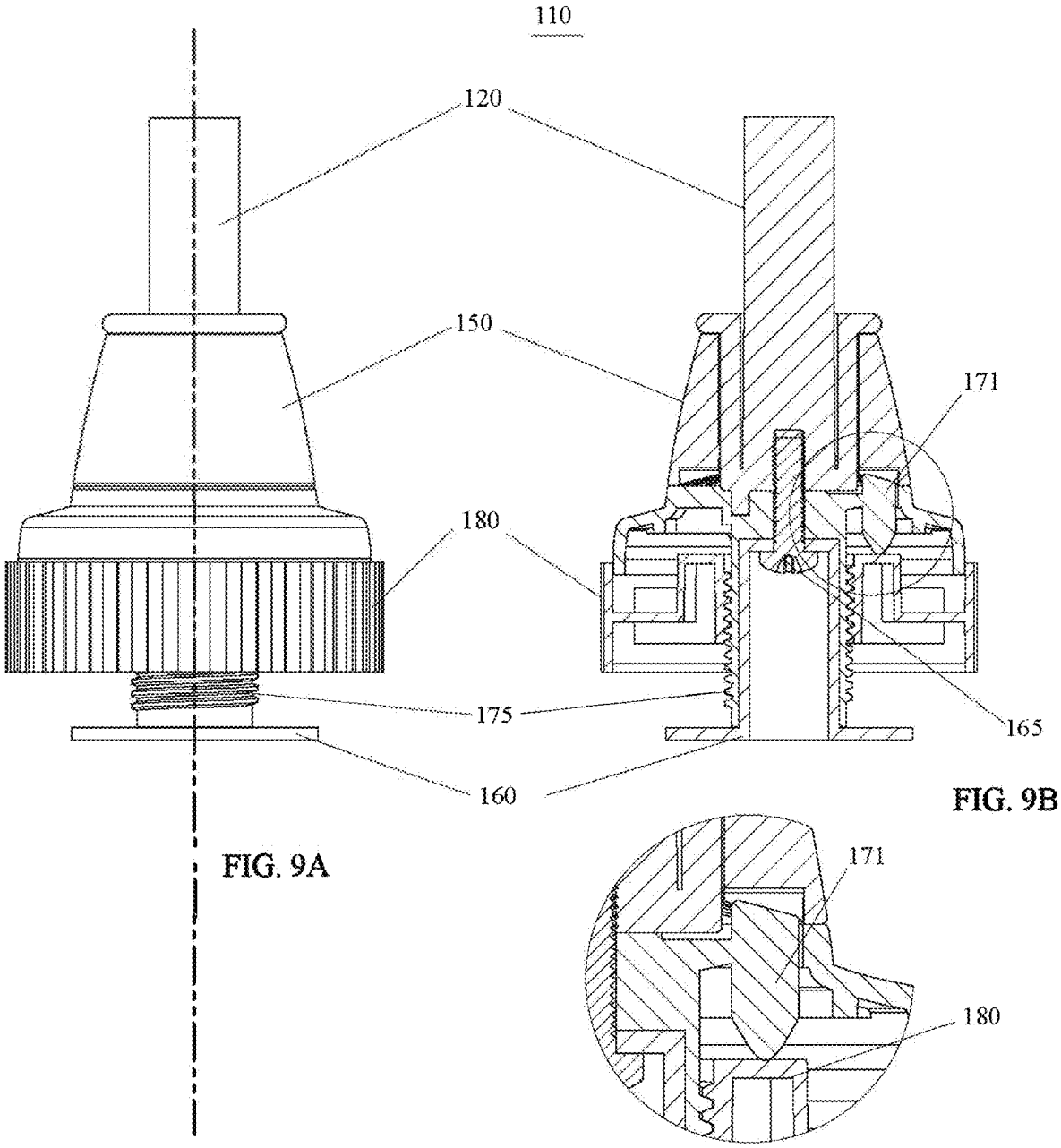
FIGS. 9A-B illustrate inner and outer structure of an assembled adjustable tension control cap in accordance with at least one embodiment.
Figure 10A:
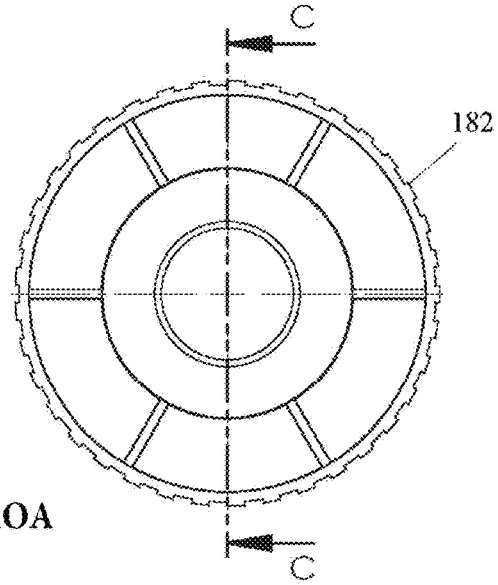
FIGS. 10A-E illustrate inner and outer structure of a tension adjustment dial component of an adjustable tension control cap in accordance with at least one embodiment.
Figure 10B:
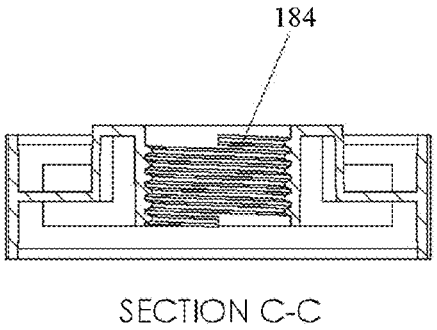
Figure 10C:
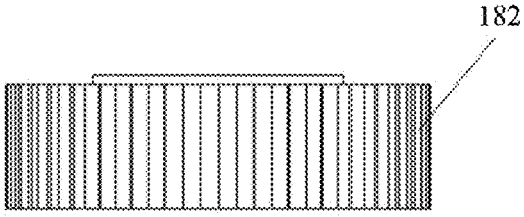
Figure 10D:
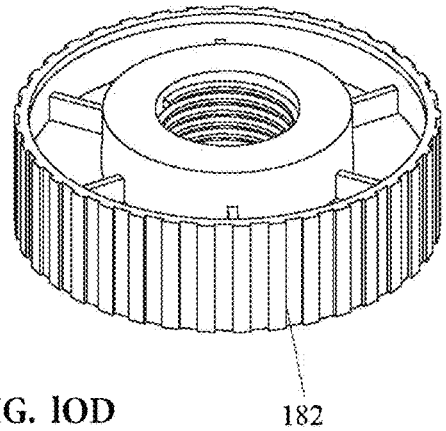
Figure 10E:
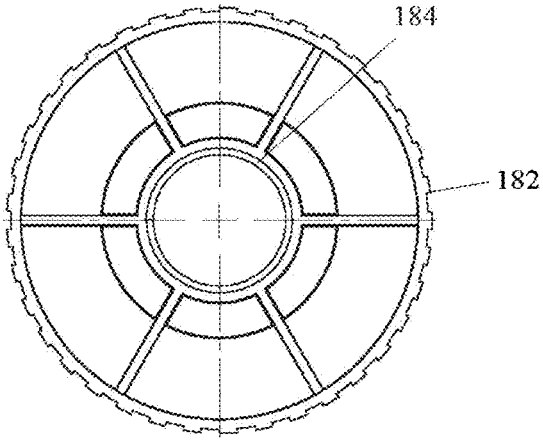

FIGS. 9A-B illustrate the structure of an assembled adjustable tension control cap in accordance with at least one embodiment of the present invention. Referring to FIGS. 9A and 9B, the downward movement of the tension adjustment dial 180 pushes downward the braking blades 171, each of which is either integrally connected to, or molded as a part of, the spring base 170 at the corresponding attachment point 172. The downward movement of the braking blades 171 decreases frictional contact of the blades with the inner surface 155 of the rotor 150, loosening the tension with which the roll is held by the dispenser and increasing the rotational speed during dispensing operation.

This allows the user to adjust tension and rolling speed of the dispenser for faster unrolling when more material is desired. On the other hand, setting the slower rotational speed and tighter tension may help prevent the excessive unrolling and waste of the rolled paper (or other material).

The structure and operation of the limit cap 160, constructed in accordance with at least one embodiment, is further illustrated in FIGS. 5A-D. The limit cap 160 may have a generally tubular shape and a wider skirt 161 at the bottom. In at least one embodiment, the limit cap may also have a threaded opening 162, to accommodate a screw 165 that attaches and holds together the components of the adjustable tension control cap 110. The limit cap 160 is constructed to limit the upwards and/or downward movement of the tension adjustment dial 180 along the threaded shaft 175 of the spring base 170.

The inner and outer structure and operation of the rotor 150 (also referenced as a race cap) in accordance with at least one embodiment is further illustrated in FIGS. 6A-E. The rotor includes a ribbed inner surface 155, which comes into frictional contact with the braking blades 171 of the spring base 170, increasing the friction when the blades 171 are made to extend further upward, as a result of the upward movement of the tension adjustment dial 180 along the threaded shaft 175 of the spring base 170.

As illustrated in FIGS. 20A-E, the rotor 150 includes multiple lips, cavities (or openings) 152 on the upper part of the outer surface, for accommodating and holding the multiple tension rod wires 130 that are used with a column or solid rod part 137 to hold the roll in place and exert the adjustable force during the rotation and dispensing of the rolled material.

FIGS. 12A and 12B illustrate the components of a paper roll dispenser that utilizes at least one embodiment of an adjustable tension control cap of the present invention. In addition to the above-mentioned and described components of the adjustable tension control cap of the present invention, the paper roll dispenser shown in FIGS. 12A and 12B utilizes a number of other components of a paper roll dispenser, some of which are known and currently used in some products. Thus, at least one embodiment of the present invention may be utilized with the components of a regular paper dispenser that is already in use by many consumers.

Figure 13A:
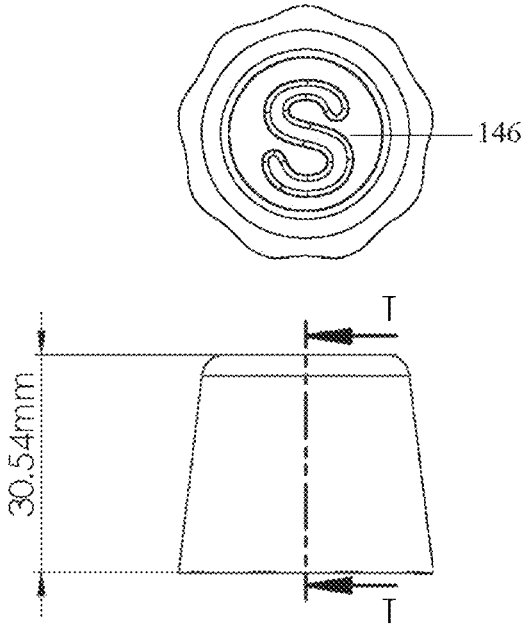
FIGS. 13A-B illustrate structure of a finial component of a paper roll dispenser that utilizes an adjustable tension control cap in accordance with at least one embodiment.
Figure 13B:
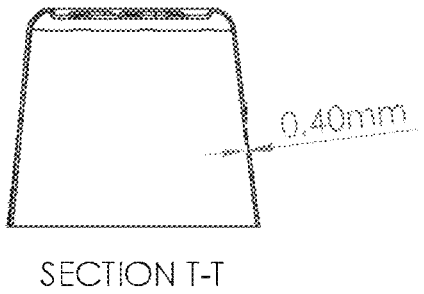
Figure 14A:
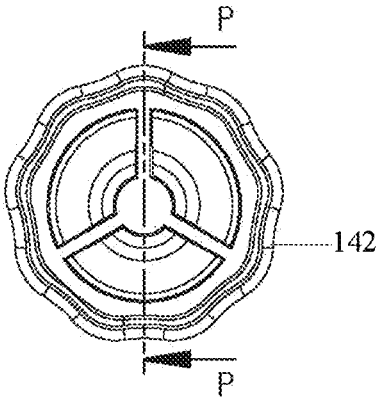
FIGS. 14A-D illustrate inner and outer structure of a finial grip component of a paper roll dispenser that utilizes an adjustable tension control cap in accordance with at least one embodiment.
Figure 14B:
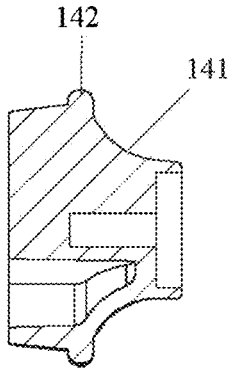
Figure 14C:
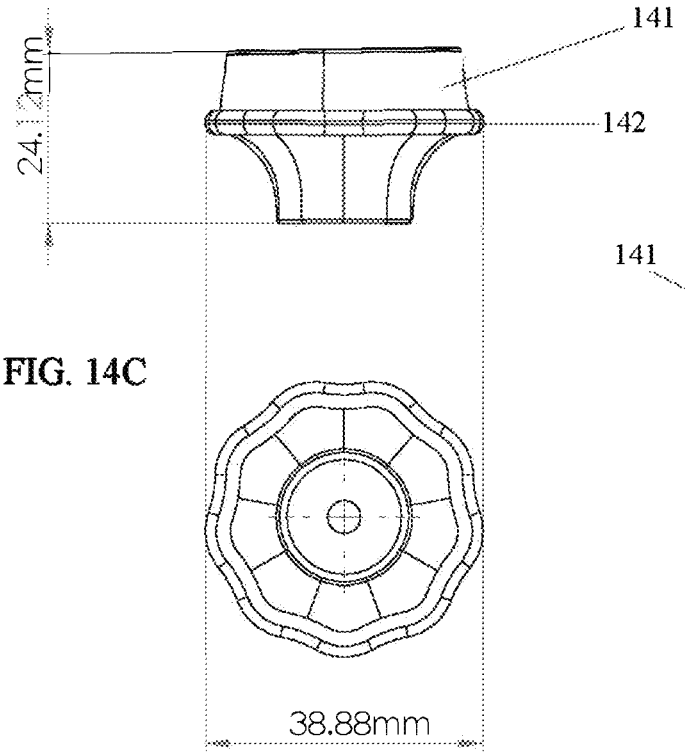
Figure 14D:
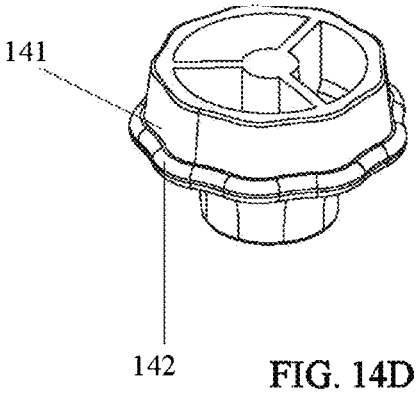

The inner and outer structure of a finial 145 component of a paper roll dispenser that may be utilized with an adjustable tension control cap of at least one embodiment of the present invention is illustrated in FIGS. 13A and 13B. The finial 145 covers the finial grip 140 (shown in FIGS. 14A-D) and the thinner tip part 138 of the solid rod part 137 (shown in FIGS. 16A-B). The top surface 146 of the finial 145 may display a logo or a name, which can be inscribed, printed, carved or otherwise shown, indicating the brand name.

The inner and outer structure of the finial grip 140 component of a paper roll dispenser that may be utilized with an adjustable tension control cap of at least one embodiment of the present invention is illustrated in FIGS. 14A-D. The finial grip 140 may use a wider diameter at the top part 141, and the diameter of the finial grip may increase slightly toward the center, which allows the finial cover 145 to slide over the finial grip 140 and remain attached by a force of friction between the inner surface of the finial and the center portion 142 of the finial grip. This allows the finial to slide over the finial grip 140 and remain attached during the dispensing operation. In at least one other embodiment, the finial grip 140 may have a slightly wider diameter bulbous area, which extends from the other parts and holds the finial 145 in place by a force of friction.

In at least one embodiment, the finial grip 140 may have a smaller diameter cavity 144 on the bottom surface. The cavity 144 is structured to accommodate and hold in place the thinner tip part 138 of the solid rod part 137 when the dispenser is in operation and use.

Figure 15A:
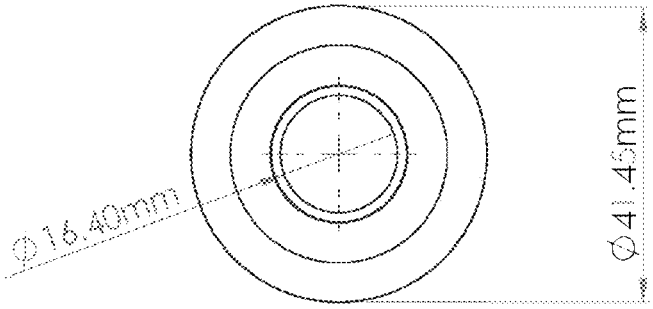
FIGS. 15A-C illustrate structure of a race top component of a paper roll dispenser that utilizes an adjustable tension control cap in accordance with at least one embodiment.
Figure 15B:
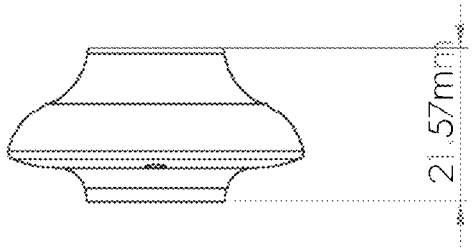
Figure 15C:
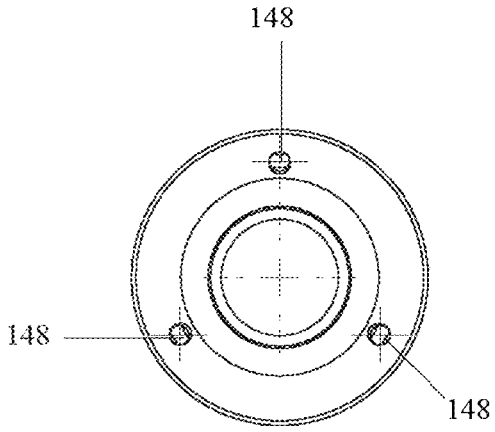

The structure of the race top 147 component of a paper roll dispenser that may be utilized with an adjustable tension control cap of at least one embodiment of the present invention is illustrated in FIGS. 15A-C. The race top 147 has a central opening that allows the solid rod part 137 to slide through the race top 147. The race top 147 may also have multiple cavities 148, which accommodate and hold in place the top end of each of the tension wires 130 of the dispenser 100. The bottom end of each of the multiple tension wires 130 is held in place by a corresponding lip, cavity (or an opening) 152 on the upper part of the rotor 150 (as illustrated in FIGS. 20A-E).

Figure 16A:
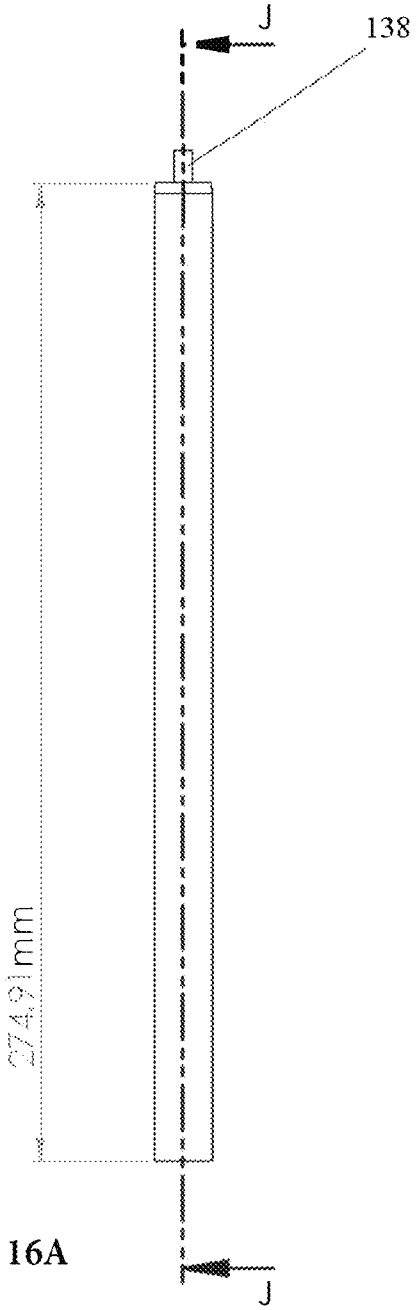
FIGS. 16A-B illustrate structure of a solid rod (also referenced as a column) of a paper roll dispenser that utilizes an adjustable tension control cap in accordance with at least one embodiment.
Figure 16B:
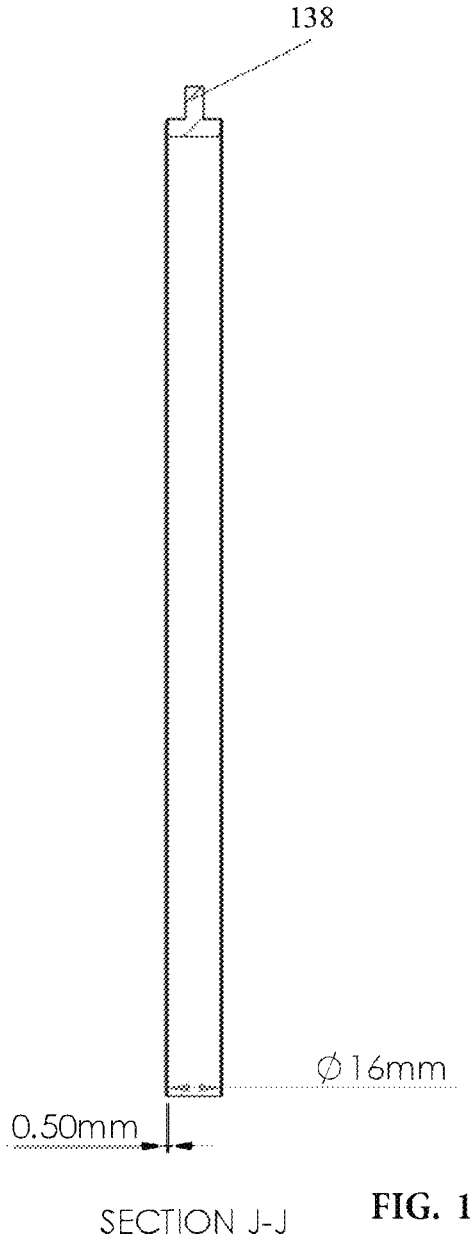
Figure 17:
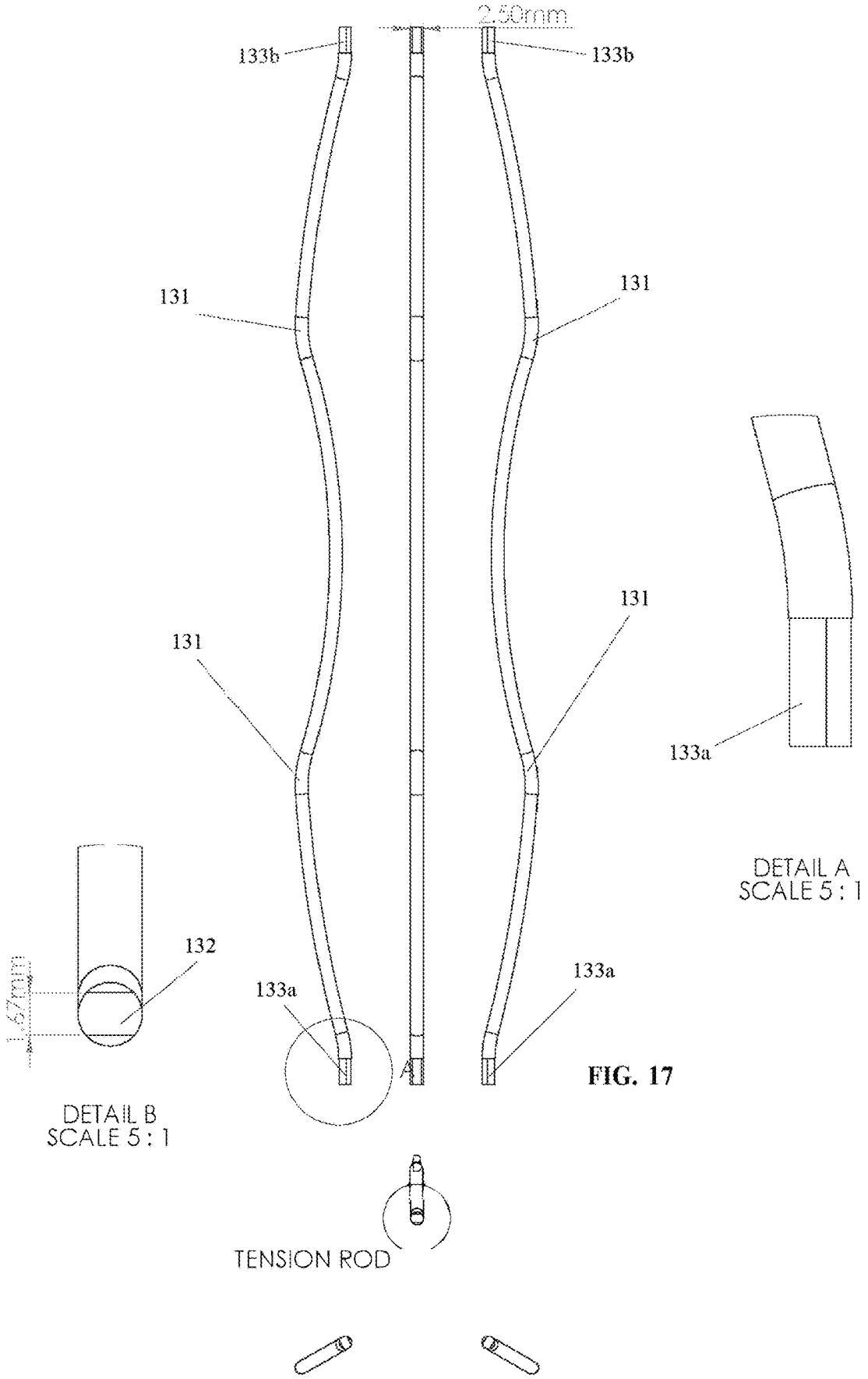
FIG. 17 illustrates structure of a tension rod component of a paper roll dispenser that utilizes an adjustable tension control cap in accordance with at least one embodiment.
Figure 18A:
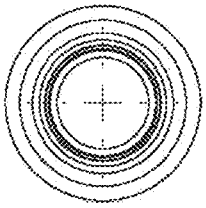
FIGS. 18A-D illustrate structure of a locking shaft (also referenced as a locking collar) of a paper roll dispenser that utilizes an adjustable tension control cap in accordance with at least one embodiment.
Figure 18B:
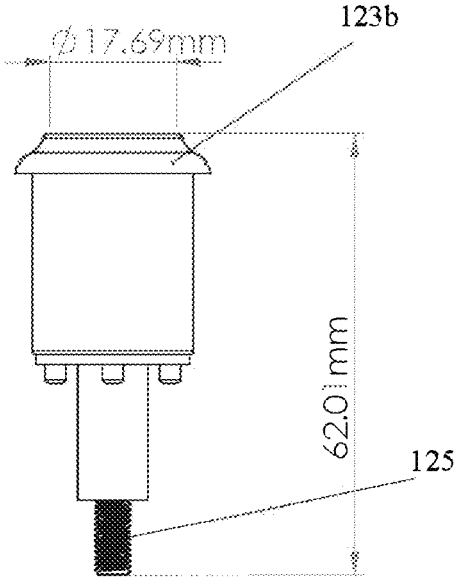
Figure 18C:
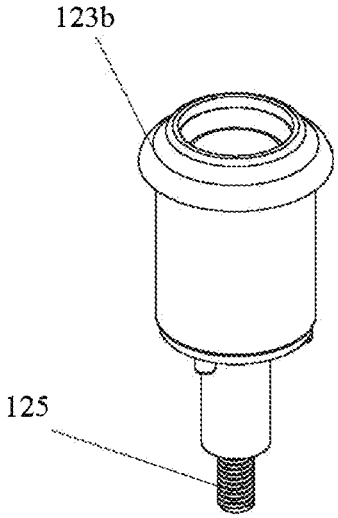
Figure 18D:
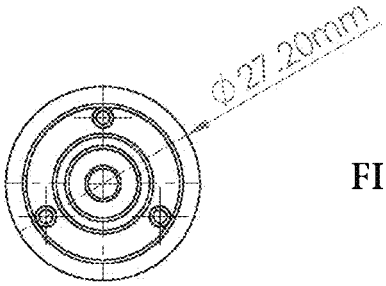
Figure 19A:
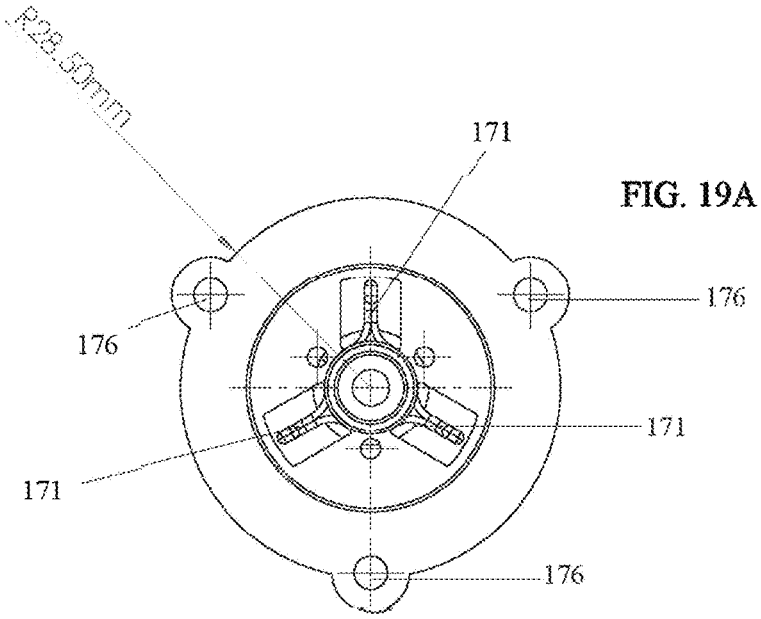
FIGS. 19A-E illustrate inner and outer structure of a spring base component of a paper roll dispenser that utilizes an adjustable tension control cap in accordance with at least one embodiment.
Figure 19B:
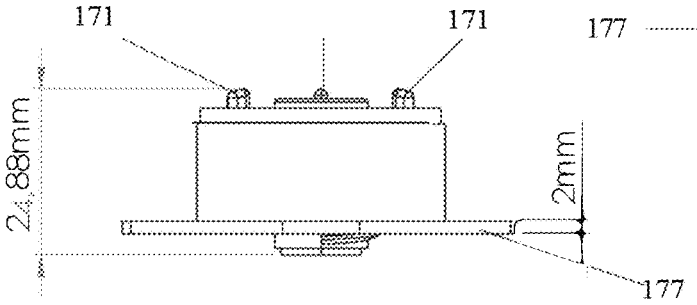
Figure 19C:
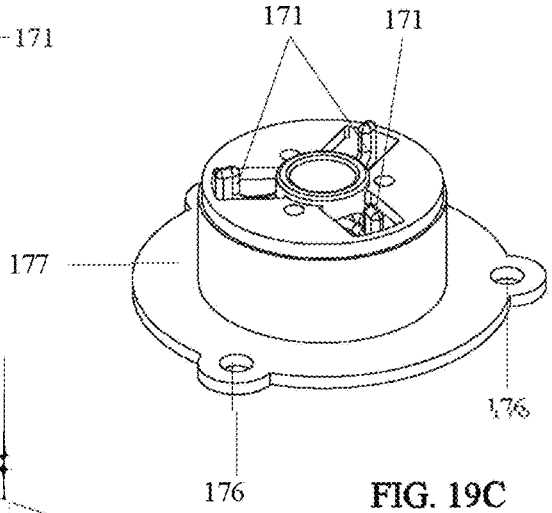
Figure 19D:
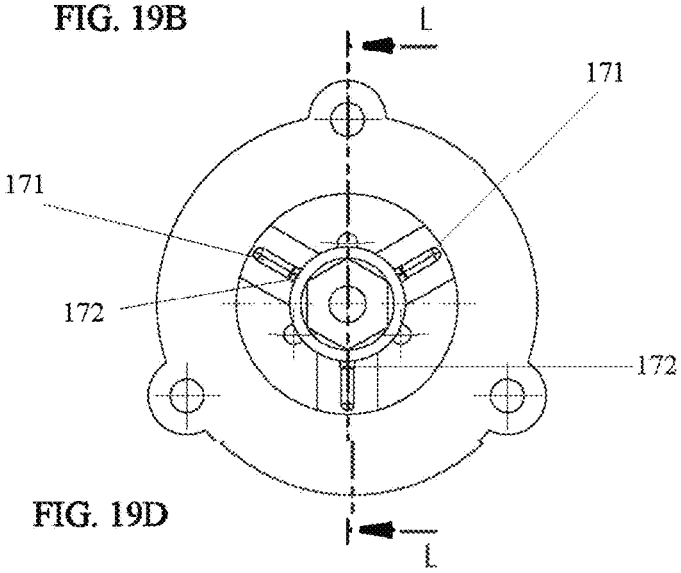
Figure 19E:
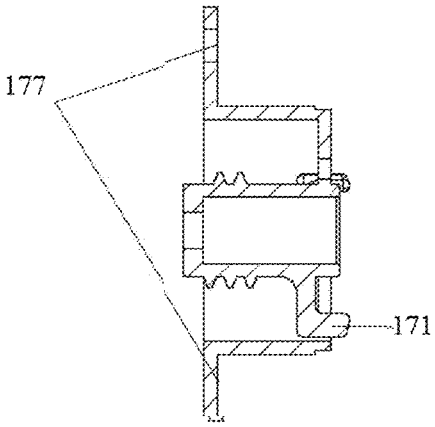
Figure 20A:
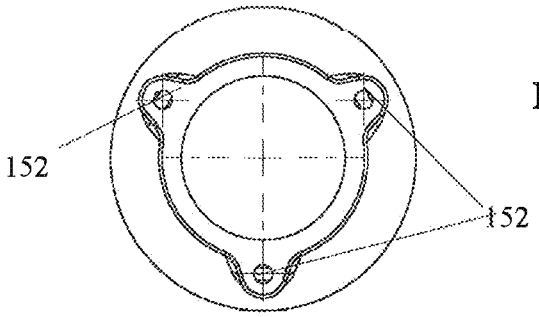
FIGS. 20A-D illustrate inner and outer structure of a race base component of a paper roll dispenser that utilizes an adjustable tension control cap in accordance with at least one embodiment.
Figure 20B:
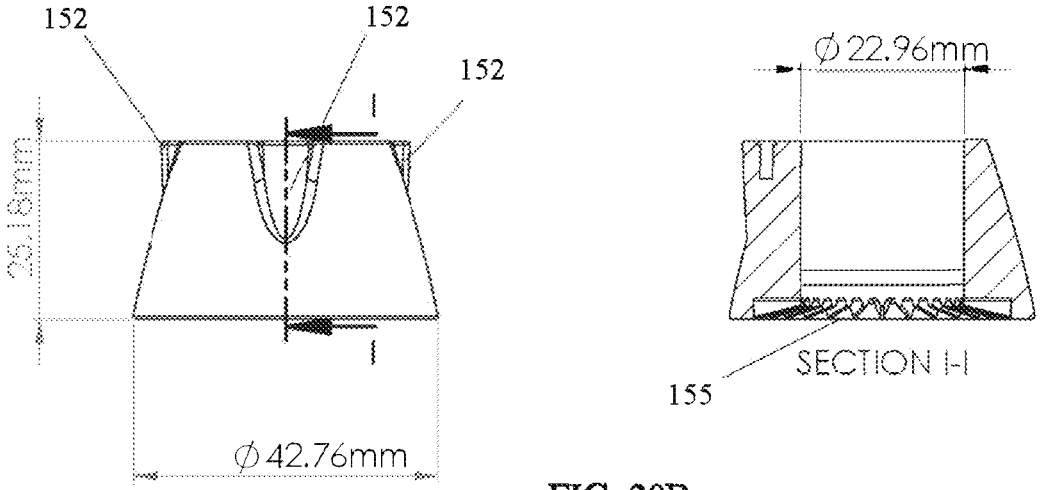
Figure 20C:
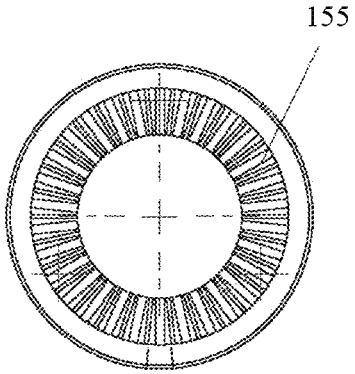
Figure 20D:
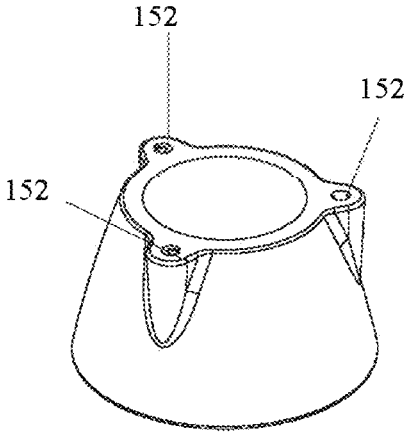
Figure 21A:
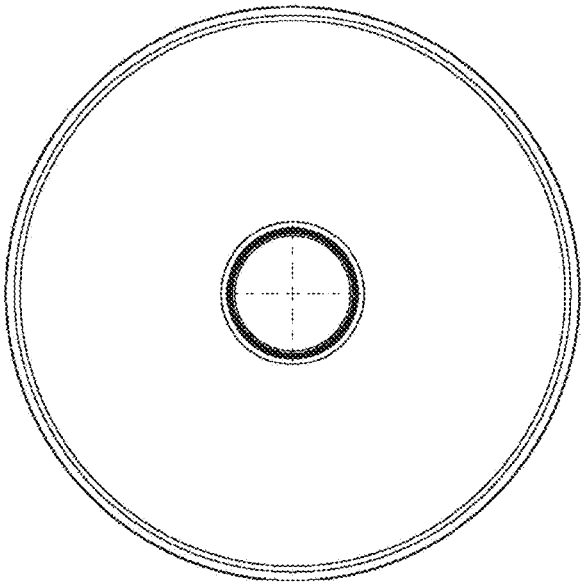
FIGS. 21A-C illustrate inner and outer structure of a weight component of a paper roll dispenser that utilizes an adjustable tension control cap in accordance with at least one embodiment.
Figure 21B:
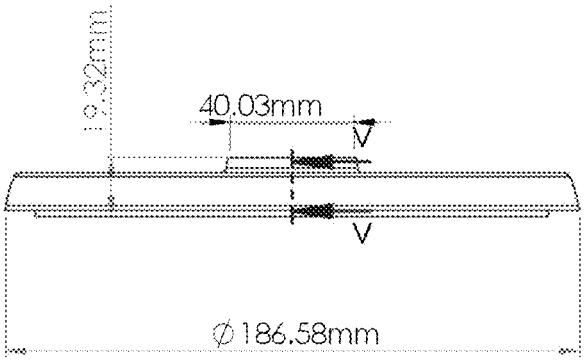
Figure 21C:
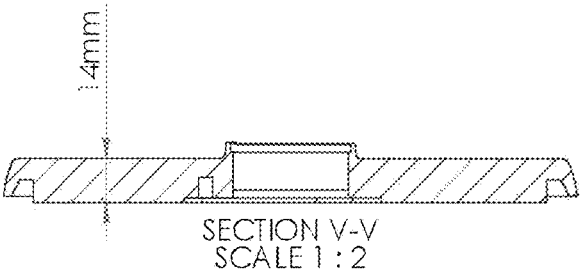
Figure 22A:
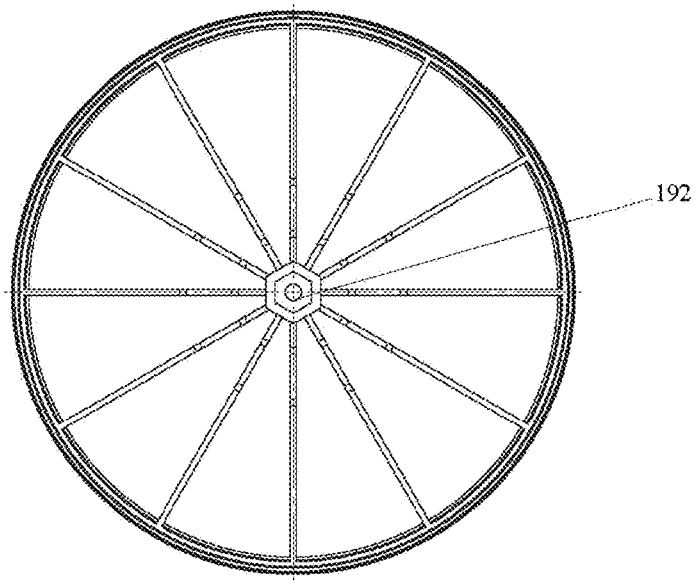
FIGS. 22A-C illustrate inner and outer structure of a base cover component of a paper roll dispenser that utilizes an adjustable tension control cap in accordance with at least one embodiment.
Figure 22B:
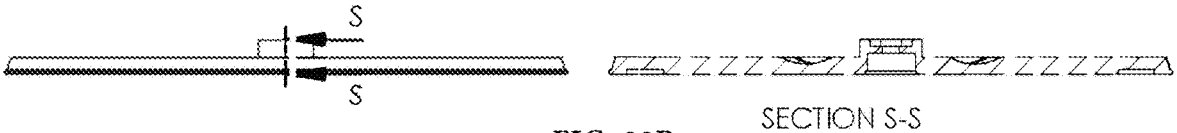
Figure 22C:
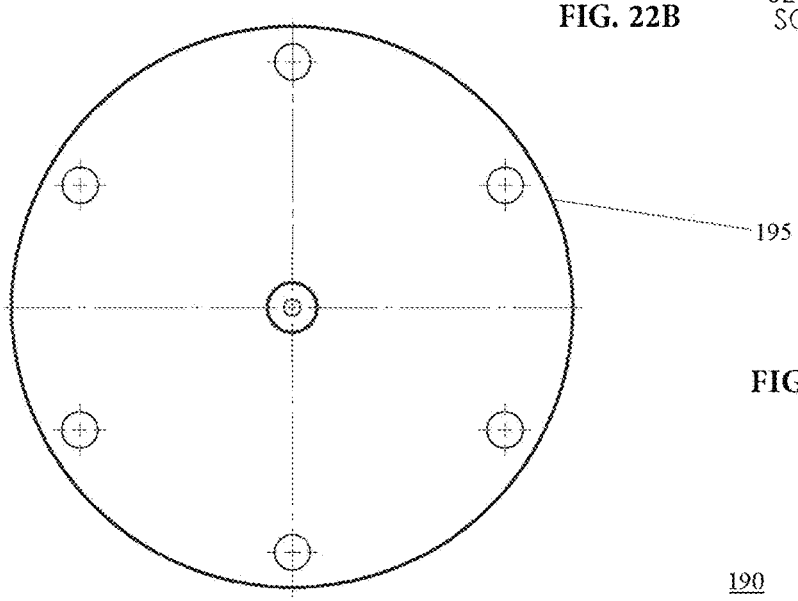

The structure of the rod wires 130 and the solid rod part 137 of the dispenser 100 are illustrated in FIGS. 16A-B and FIG. 17, respectively. The tension wires hold the roll in place and exert adjustable force during the rotation and dispensing of the rolled material. The solid rod part 137 has a tubular shape, with a thinner tip part 138, which connects to a finial grip 140 and is covered by a finial 145 on one end of the dispenser 100. At the other end, the solid rod part 137 fits through the central opening of a race top 147, and connects to the locking shaft 120 and other components of the adjustable tension control cap 110. The rod wires 130 may have multiple segments of different curvature, and may extend outwards at some segments 131, which connect to and hold the inner surface of a roll in place during the dispensing operation. The bottom surface 132 of the bottom segment 133*a* of each rod wire 130 may be generally circular, and have a diameter that is small enough to fit and remain fixed within the corresponding lip, cavity (or an opening) 152 on the upper part of the rotor 150. The top surface of the top segment 133*b* may also be generally circular and have a diameter that is small enough to fit inside and remain fixed within the corresponding cavity 148 of the race top 147, which accommodate and hold in place the corresponding tension wire during the dispensing operation.

The structure of the tension rod wires, the solid rod part, the finial and the finial grip are well-known elements of existing dispensers that are used by consumers. The adjustable tension control cap 110 of the present invention is designed to operate with existing dispensers, without having to purchase another dispenser product.

The structure of the alternative embodiment of a locking shaft 120*b* is depicted in FIGS. 18A-D. In the alternative embodiment, the locking shaft 120*b* has a wider skirt part 123*b* at the top, which connects it to the solid column (or rod) part 137. On the bottom surface, the locking shaft 120*b* has a connecting screw 125, which connects it to other components of the adjustable tension control cap 110. The bottom part of the screw 125 is covered by a screw cover 168, whose structure is shown in FIGS. 26A-C.

An alternative embodiment of a spring base component 170*b* of an adjustable tension control cap in accordance with at least one embodiment is discussed above, with reference to FIGS. 19A-E. The structure of a rotor (also called a race base) component 150 of an adjustable tension control cap in accordance with at least one embodiment is discussed above, with reference to FIGS. 20A-E.

The structure of a tension adjustment dial 180 and other related components of at least one embodiment of the present invention are illustrated in FIGS. 21-25. A base cover 190, illustrated in FIGS. 22A-B, has a circular open structure, with multiple connecting spokes connecting the outer circumference to the inner circular surface, with a circular opening 191 in the middle.

Figure 23A:
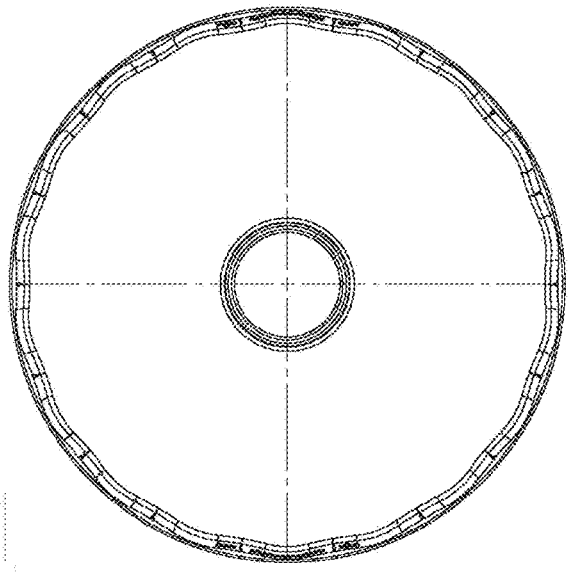
FIGS. 23A-C illustrate inner and outer structure of a base shell component of a paper roll dispenser that utilizes an adjustable tension control cap in accordance with at least one embodiment.
Figure 23B:
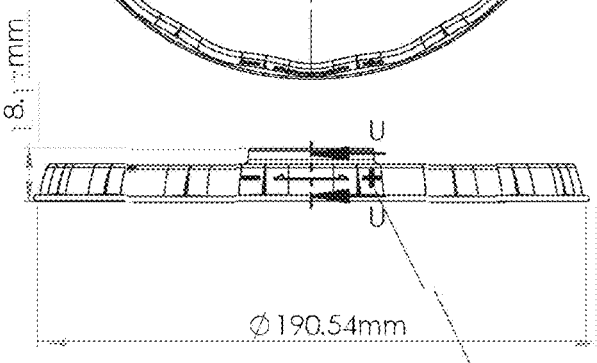
Figure 23C:
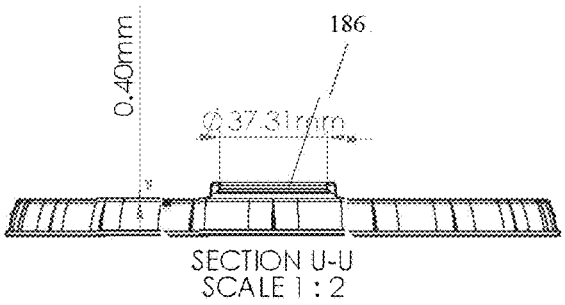
Figure 24A:
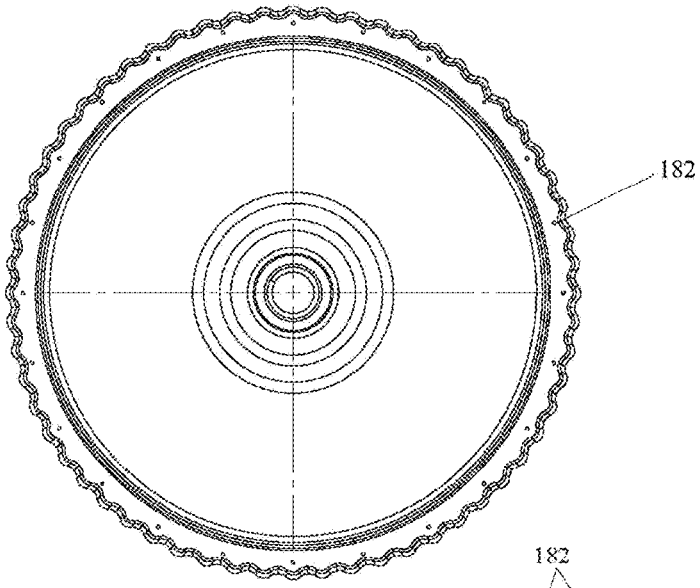
FIGS. 24A-D illustrate inner and outer structure of a tension adjustment dial of a paper roll dispenser that utilizes an adjustable tension control cap in accordance with at least one embodiment.
Figure 24B:
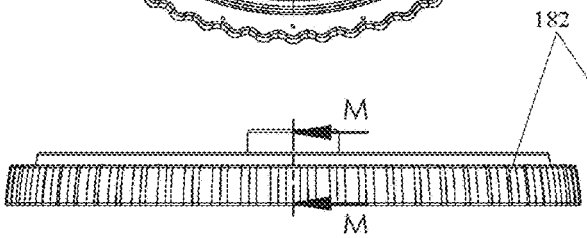
Figure 24C:
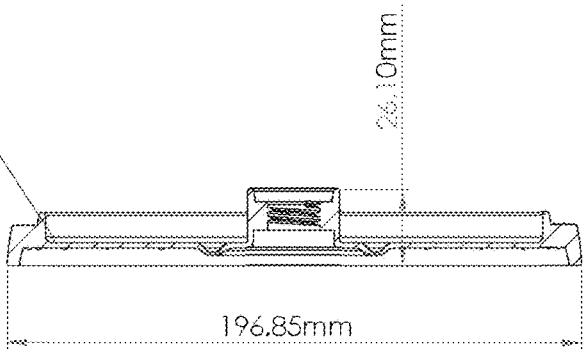
Figure 24D:
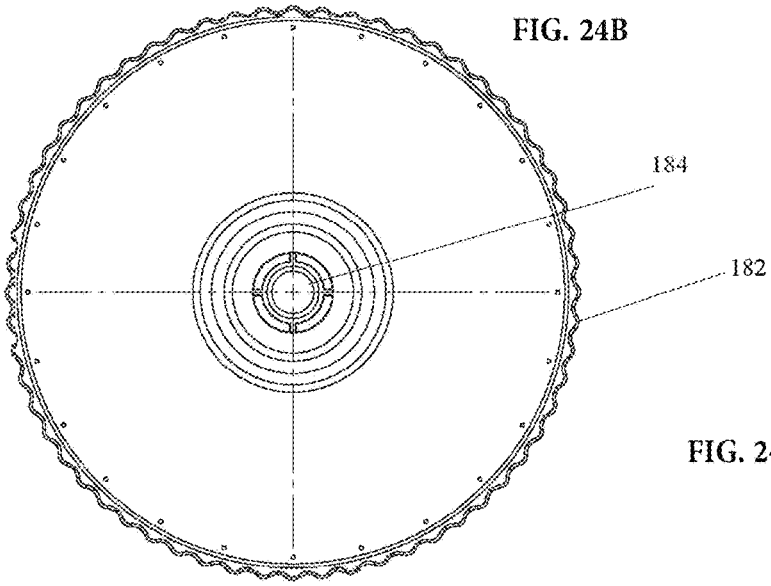

A base shell component 192 is illustrated in FIGS. 23A-C. The base shell 192 may be made of a solid metallic, plastic, wooden or other type of material, and may fit over the base cover 190. In at least one alternative embodiment, the base shall 192 may be used without the base cover 190, directly covering the tension adjustment wheel 180 and the weight 188. The base shell 192 has a circular opening in the center and the tension dial display 185 on the side surface, indicating the direction of rotation to tighten the tension exerted on the held roll and the direction to reduce the speed of rotation during the dispensing (shown as "+" in FIGS. 1A-B), and the opposite direction, to loosen the tension of the held roll and increase the speed of rotation (shown as "–" in FIGS. 1A-B).

The structure of a tension adjustment dial 180 of at least one embodiment of the present invention is illustrated in FIGS. 24A-D. It comprises an outer ribbed surface 182, which can be made of plastic or stretchable material, and is constructed to fit over the outer perimeter of a weighted part 186, illustrated in FIGS. 21A-C.

In an alternative embodiment, the tension adjustment dial 180 may be made of a solid material, with a hollow center and can fit (stack) on top of a weighted part 186. A bottom base cover 195, shown in FIG. 22C may fit under and cover (from the bottom) the weighted part 186 and/or the tension adjustment dial component 180.

Figure 25:
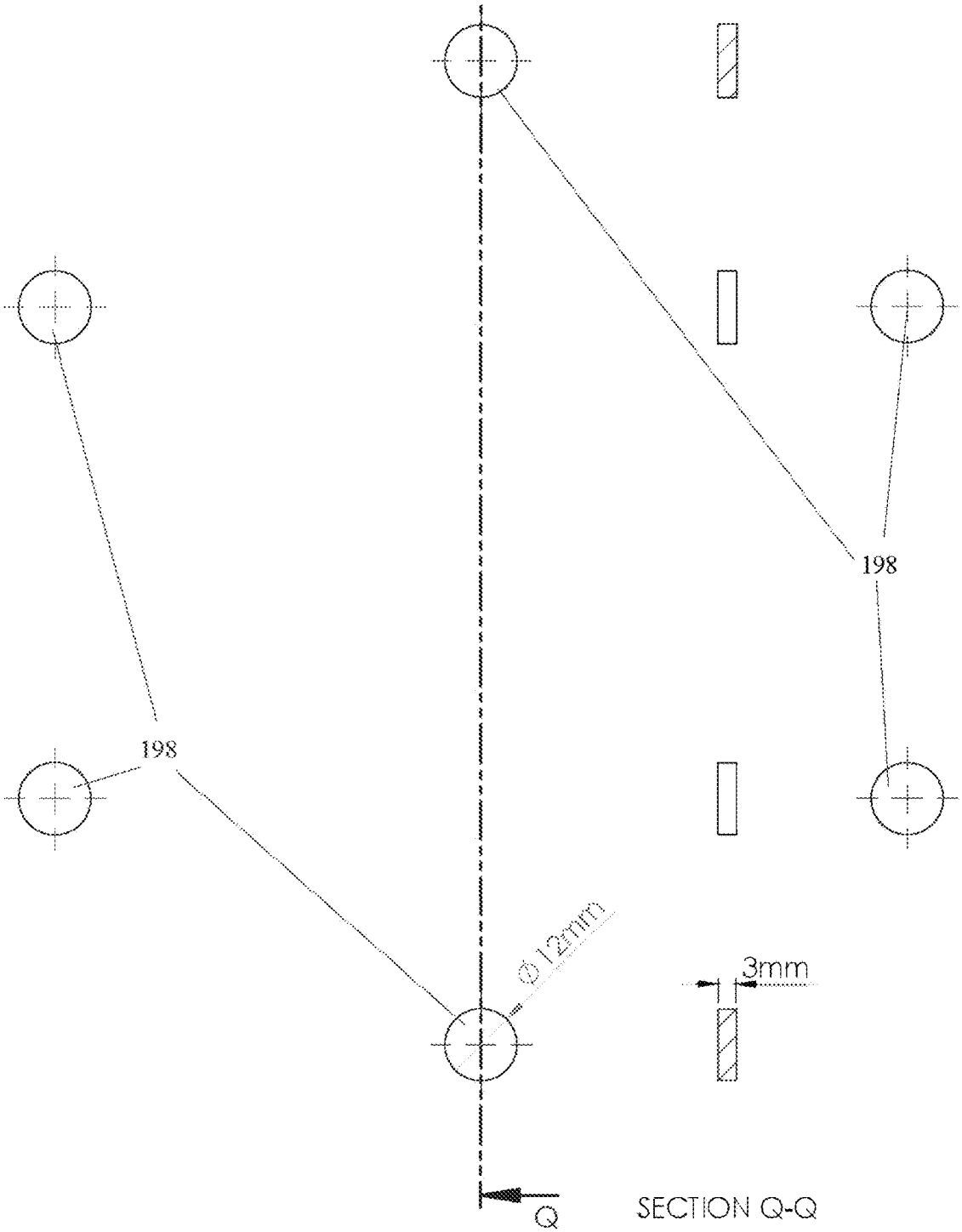
FIG. 25 illustrates structure of a non-skip (or non-slip) pad component of a paper roll dispenser that utilizes an adjustable tension control cap in accordance with at least one embodiment.

It is understood that the weighted part 186 is optional and may be added above or below the adjustment dial 180 in at least one embodiment of the present invention. The bottom base cover 195, shown in FIG. 22C, may have multiple openings, structured to accommodate and hold in place a non-skid or non-slip pad 197, connected to the bottom base cover through each of the multiple openings 198 by a connecting member, as shown in FIG. 25.

In accordance with another embodiment of the present invention, the non-skip pad 197 may be glued to the bottom surface of the bottom base cover 195, to the bottom surface of the weighted part 186, or to the bottom surface of the tension adjustment dial component 180.

The screw cover 168, whose structure is shown in FIGS. 26A-C, covers the tip of the connecting screw 125 (of the locking shaft 120*b*), which connects other components of the adjustable tension control cap 110. The screw cover 168 may have a logo or brand name engrave, glued, or otherwise depicted on or attached to the bottom surface.

Another embodiment of the present invention, shown in FIGS. 27-35, utilizes the adjustable tension control cap 210 with a tension control adjustment dial 280 with a toilet paper dispenser 200. FIGS. 27A-E illustrate different angle views of a toilet paper dispenser that utilizes the adjustable tension control cap in accordance with at least one embodiment of the present invention.

Figure 28A:
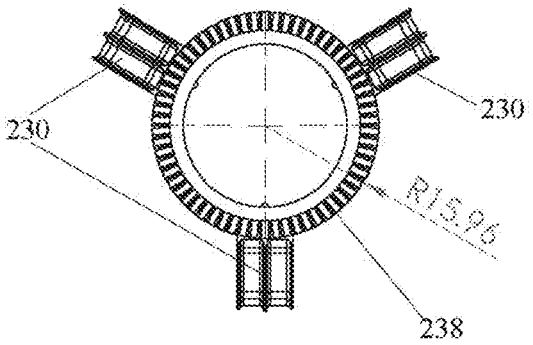
FIGS. 28A-D illustrate inner and outer structure of a tension grip component of a toilet paper dispenser that utilizes an adjustable tension control cap in accordance with at least one embodiment.
Figure 28B:
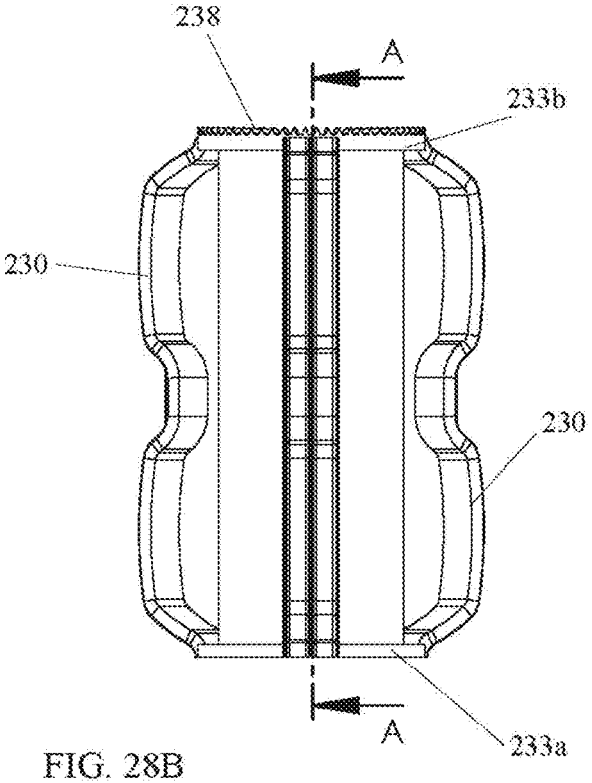
Figure 28C:
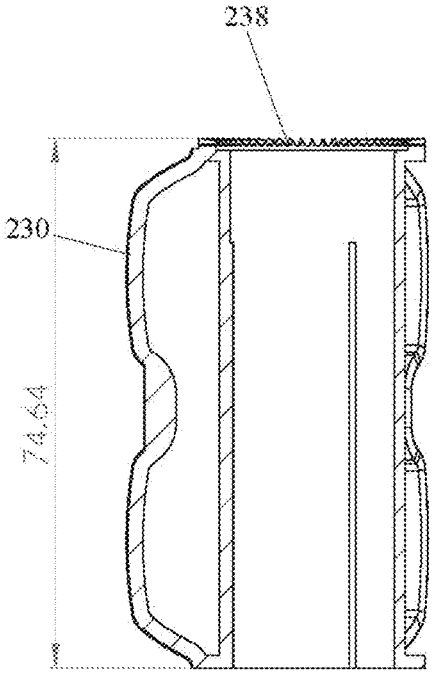
Figure 28D:
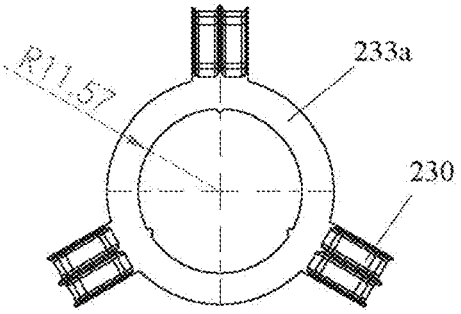
Figure 29A:
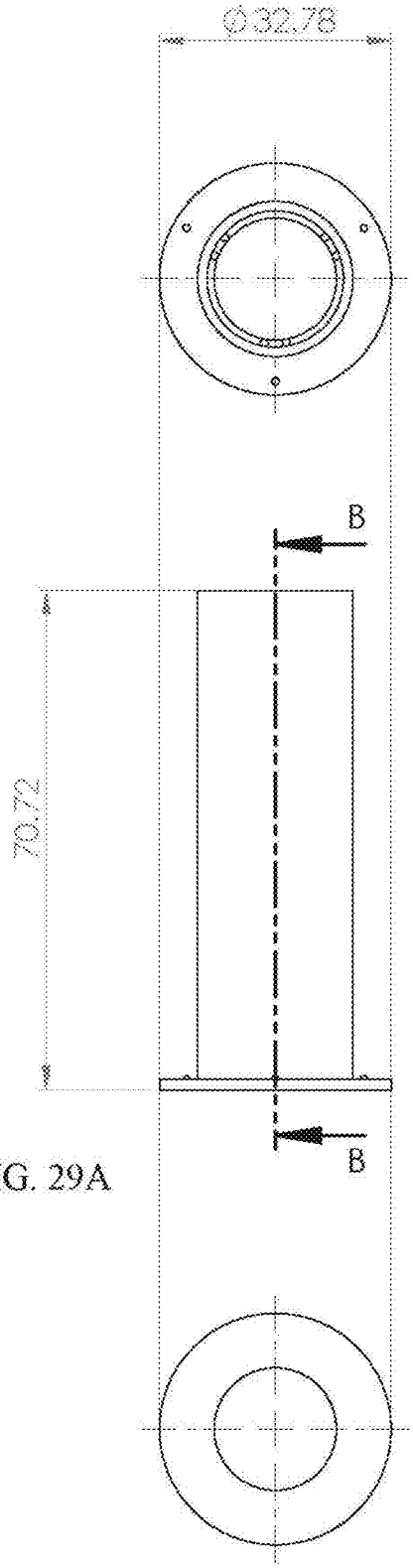
FIGS. 29A-B illustrate inner and outer structure of a spring housing component of a toilet paper dispenser that utilizes an adjustable tension control cap in accordance with at least one embodiment.
Figure 29B:
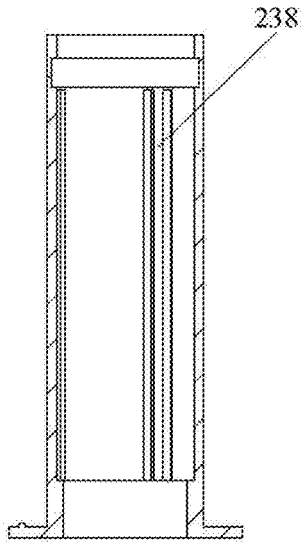
Figures 30A, 30B:
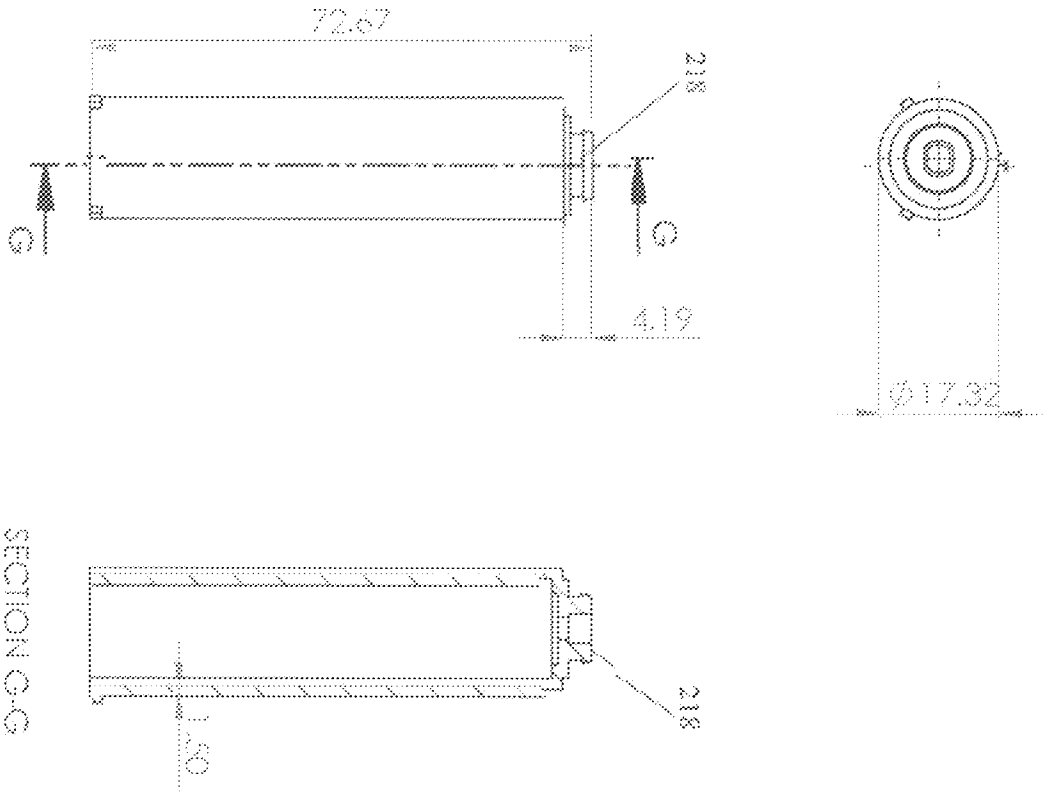
FIGS. 30A-B illustrate inner and outer structure of a tension core rod component of a toilet paper dispenser that utilizes an adjustable tension control cap in accordance with at least one embodiment.
Figure 31A:
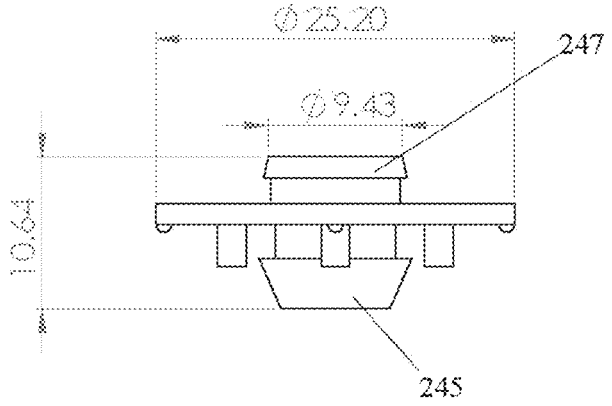
FIGS. 31A-C illustrate inner and outer structure of an end lock component of a toilet paper dispenser that utilizes an adjustable tension control cap in accordance with at least one embodiment.
Figure 31B:
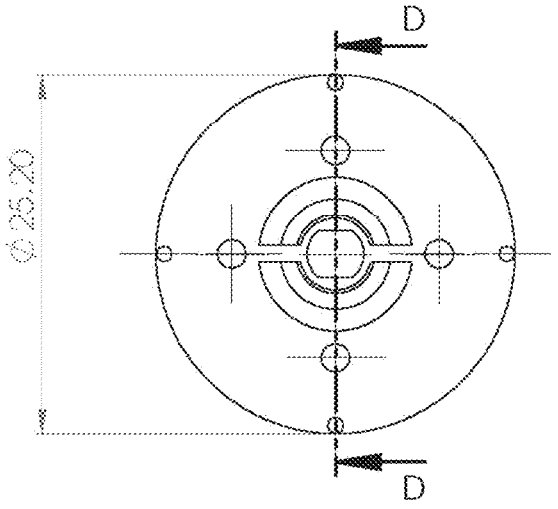
Figure 31C:
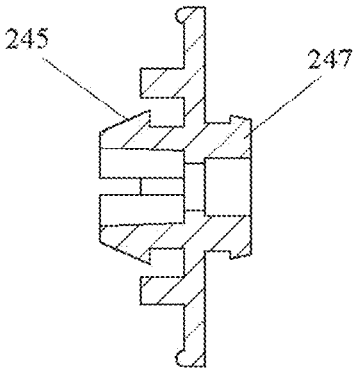
Figure 32A:
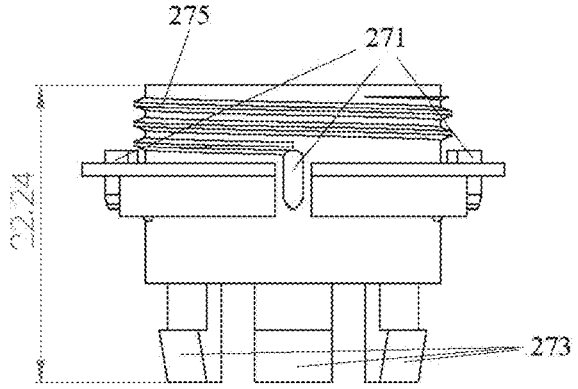
FIGS. 32A-D illustrate inner and outer structure of a spring base component of a toilet paper dispenser that utilizes an adjustable tension control cap in accordance with at least one embodiment.
Figure 32B:
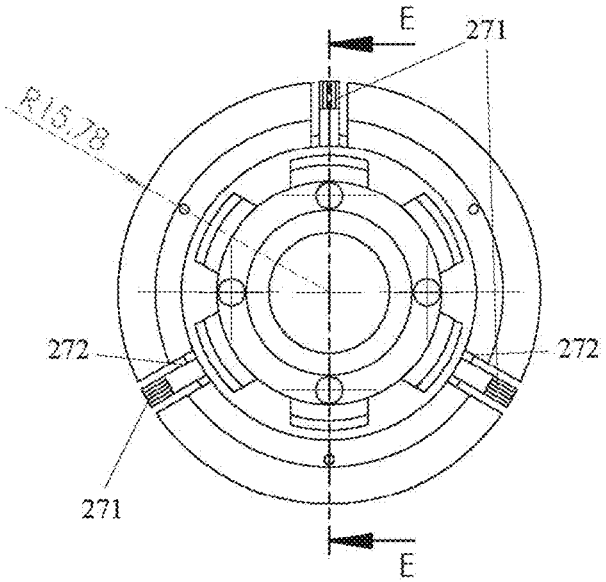
Figure 32C:
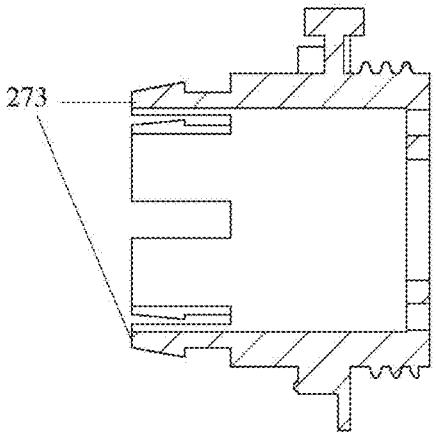
Figure 32D:
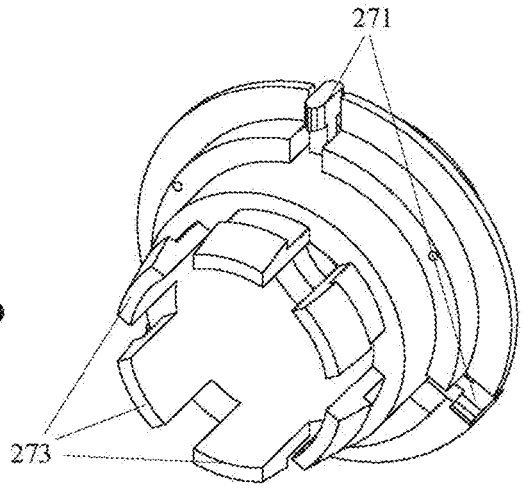
Figure 34A:
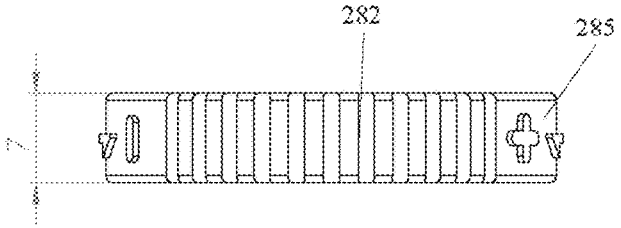
FIGS. 34A-D illustrate inner and outer structure of a tension adjustment dial component of a toilet paper dispenser that utilizes an adjustable tension control cap in accordance with at least one embodiment.
Figure 34B:
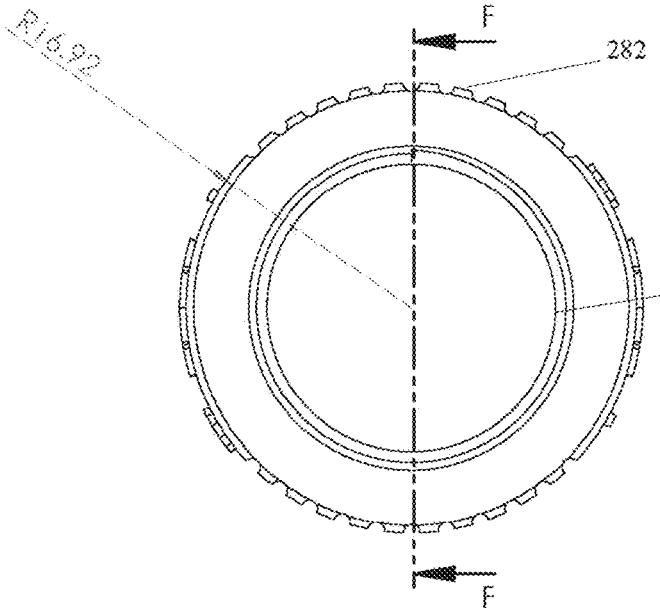
Figure 34C:
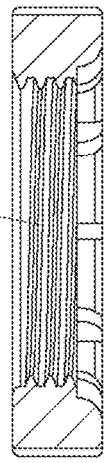
Figure 34D:
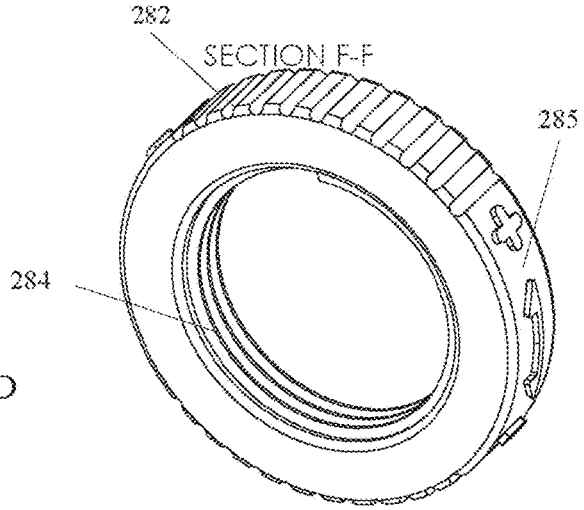
Figure 35A:
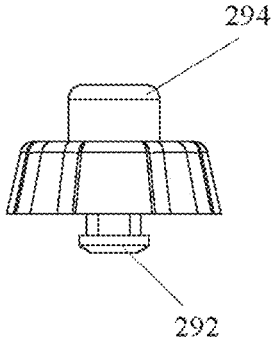
FIGS. 35A-D illustrate inner and outer structure of a non-skip (or non-slip) end component of a toilet paper dispenser that utilizes an adjustable tension control cap in accordance with at least one embodiment.
Figure 35B:
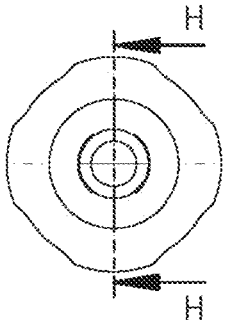
Figure 35C:
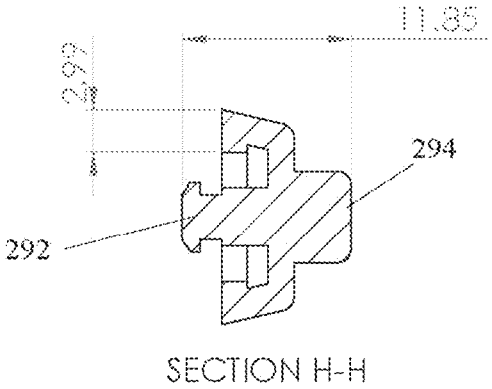
Figure 35D:
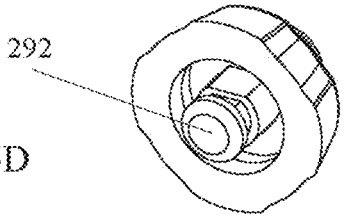

The toilet paper dispenser 200 has a tension grip part 235, which may consist of multiple plastic or metal ribs 230, connected to or molded together with two circular ends rings 233*a* and 233*b* on each end of the tension grip. The circular end rings 233*a* and 233*b* are configured to accommodate a spring housing 237, which can be either inserted though the central opening, molded or attached together as an integral part with the circular end rings 233*a* and 233*b* and the ribs 230, as shown in FIGS. 28A-C. A tension core (or rod) 220, whose structure is shown in FIGS. 30A-C, is connected on one end to the circular end ring 233*a*.

When a user exerts a force onto a tip 218 of the tension core component 220, it pushes the tension core column into the spring housing 237, through the opening, and also compresses a spring 239, which is housed inside the spring housing 237. The structure of the spring 239, illustrating the dimension of the spring from the top 239*a* and from the side view 239*b* is shown in FIGS. 33A-B.

Figure 27A:
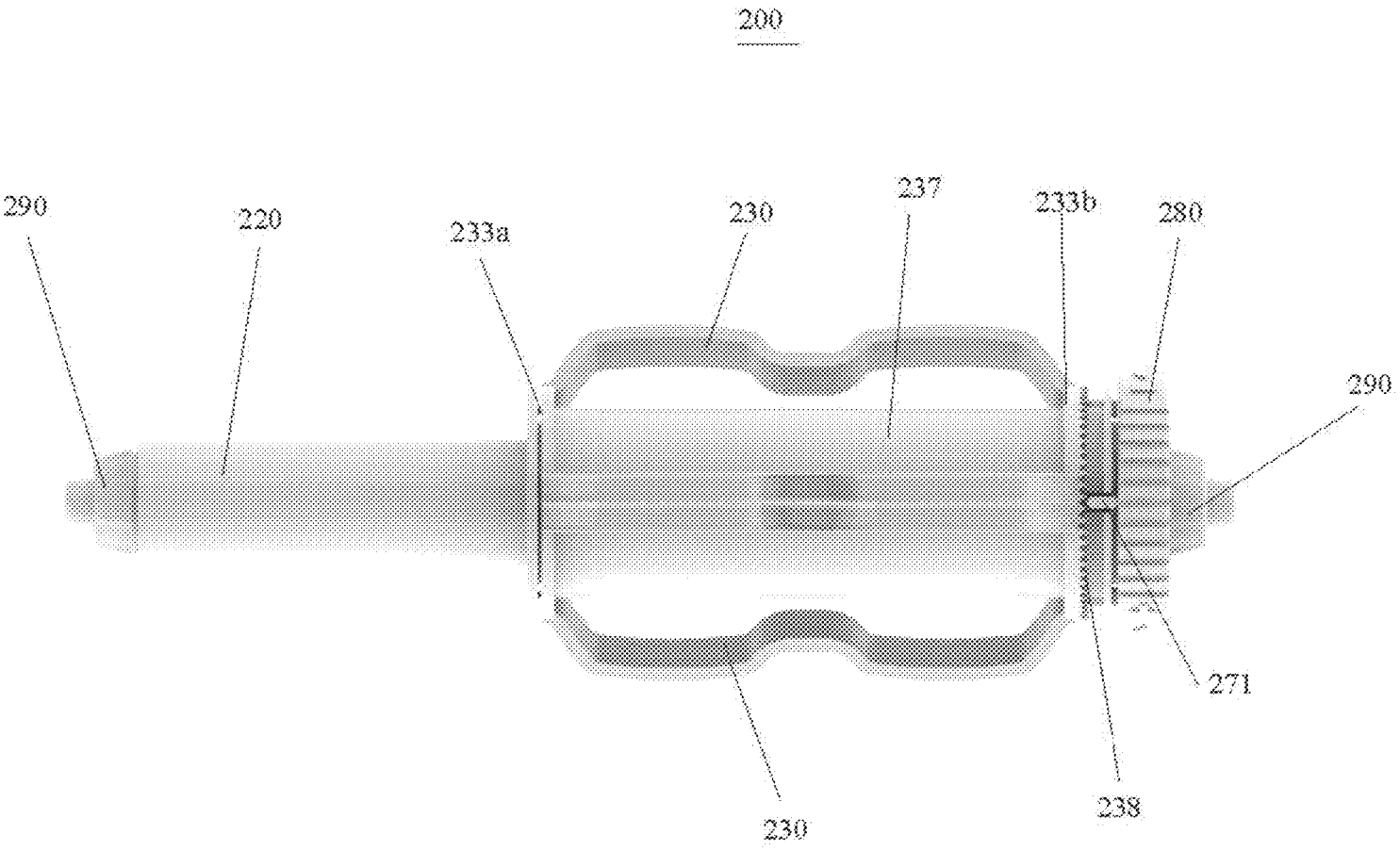
FIGS. 27A-E illustrate different angle views of a toilet paper dispenser that utilizes an adjustable tension control cap in accordance with at least one embodiment.
Figure 27B:
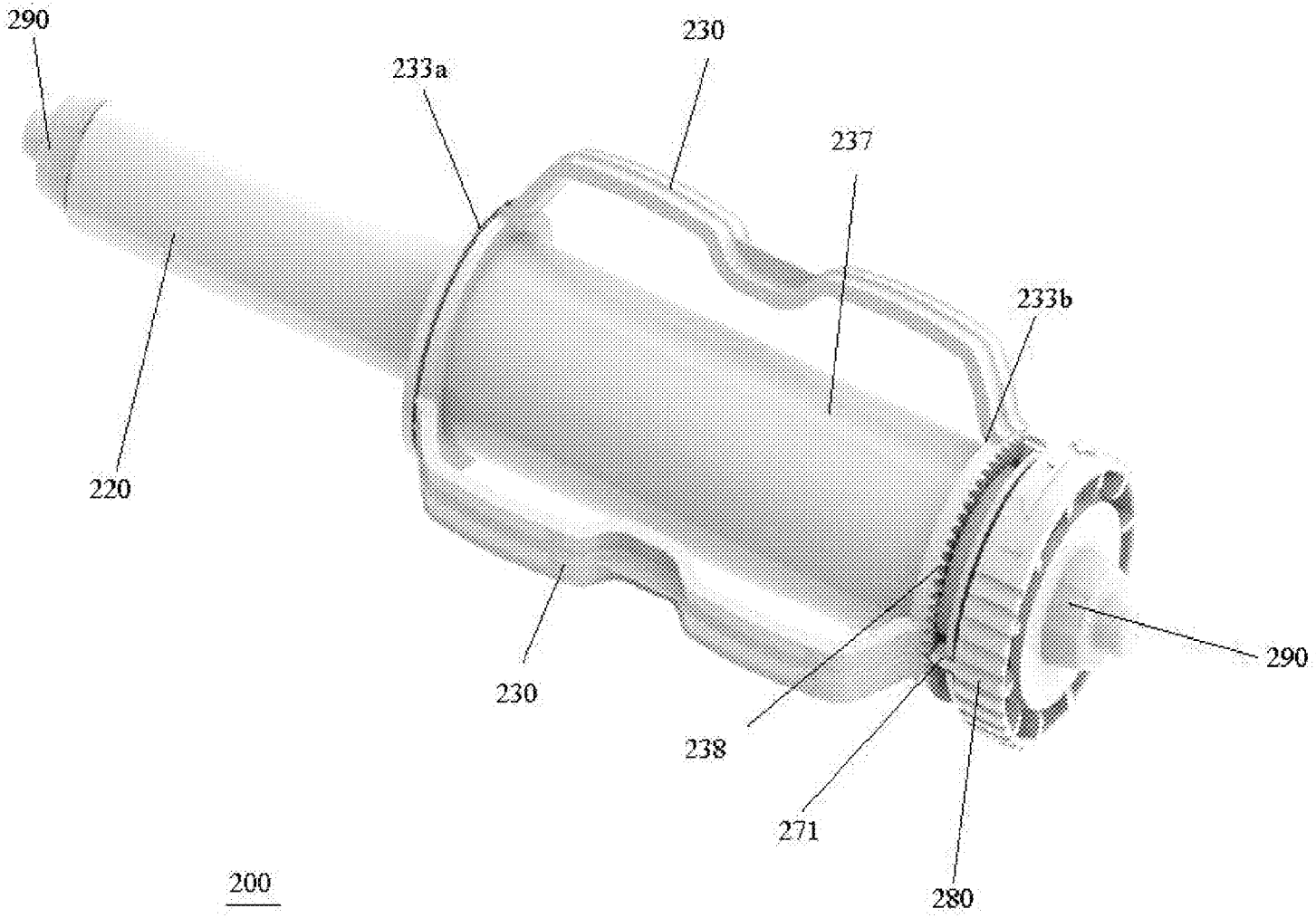
Figure 27C:
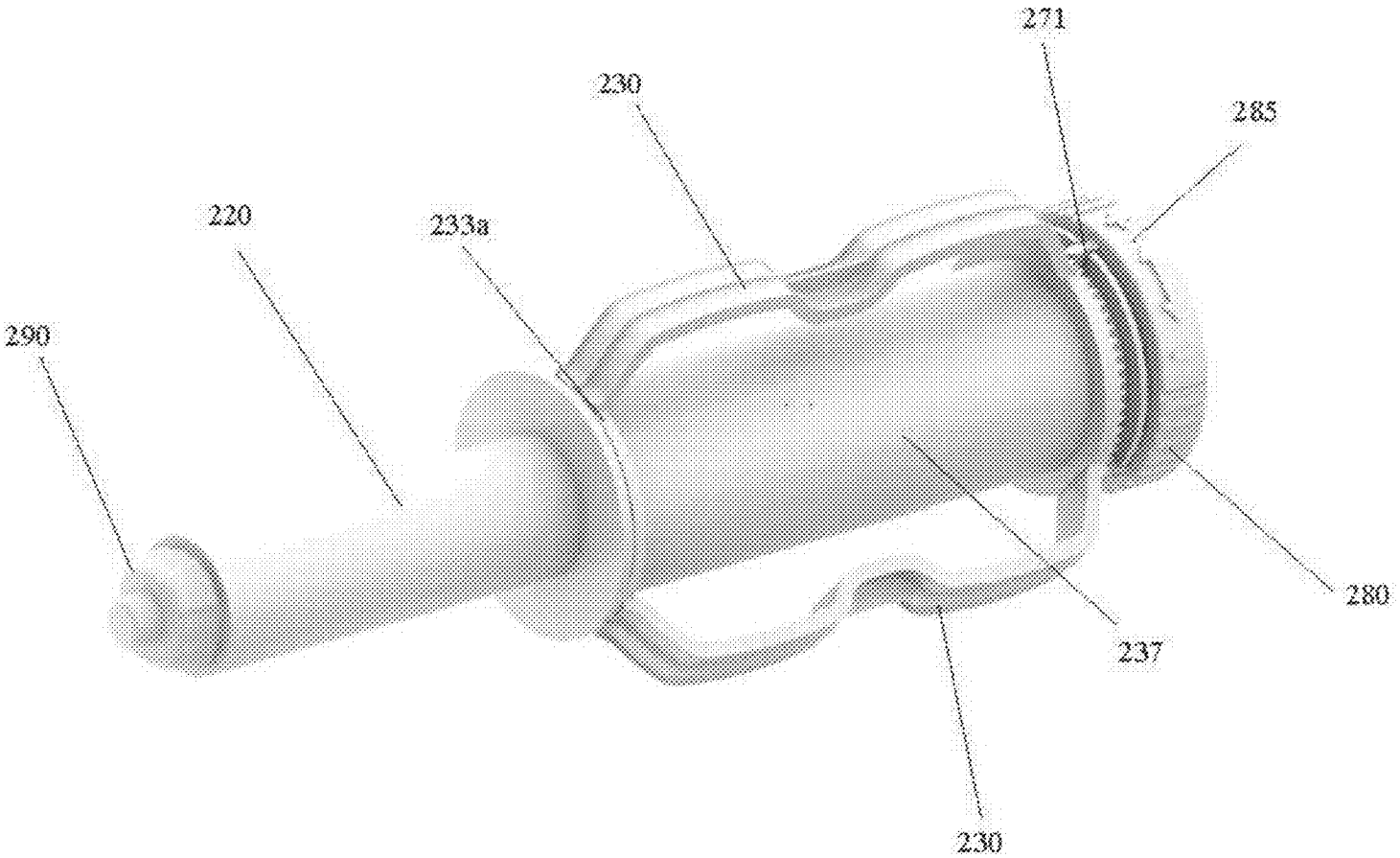
Figure 27D:
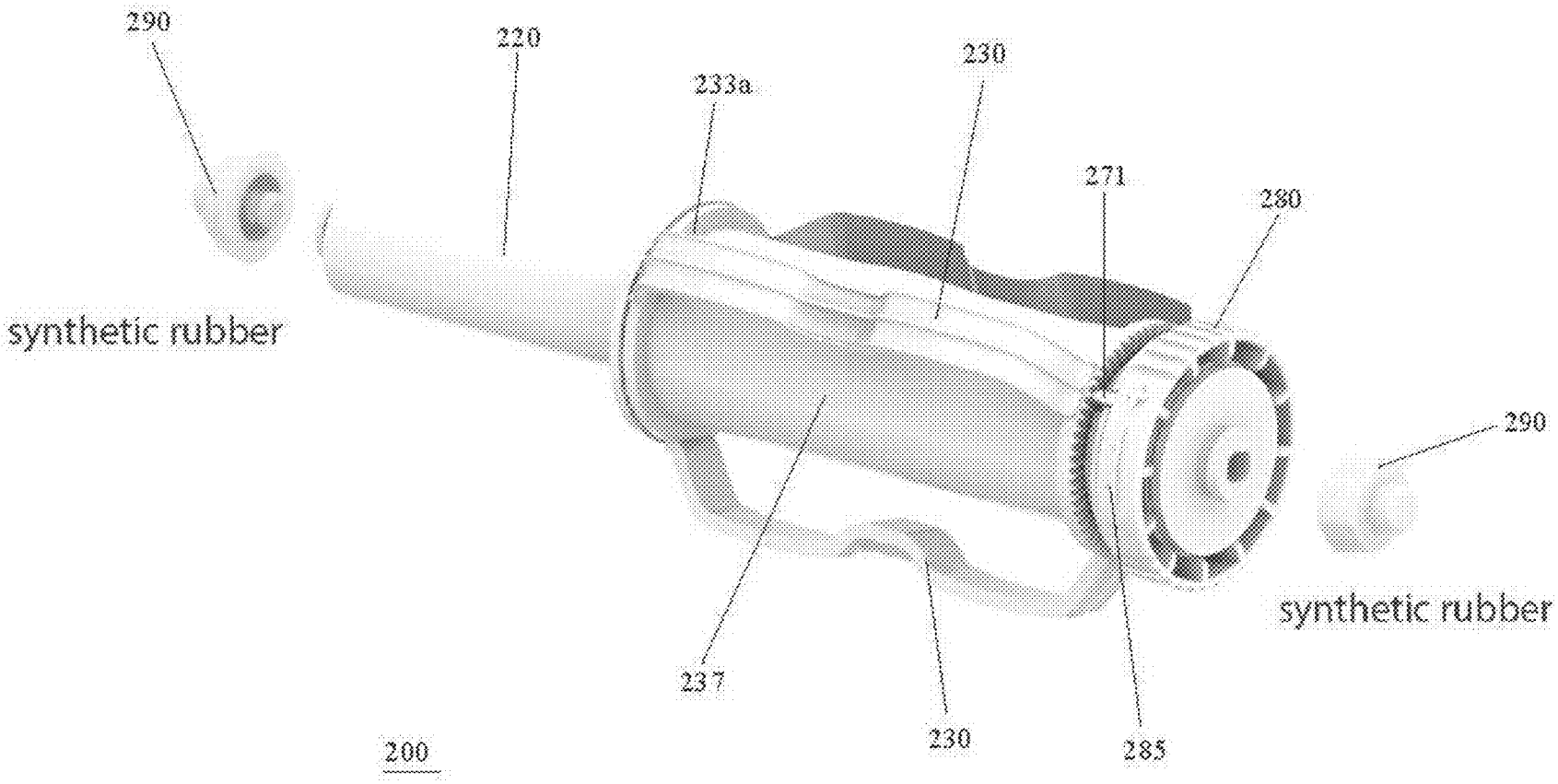
Figure 27E:
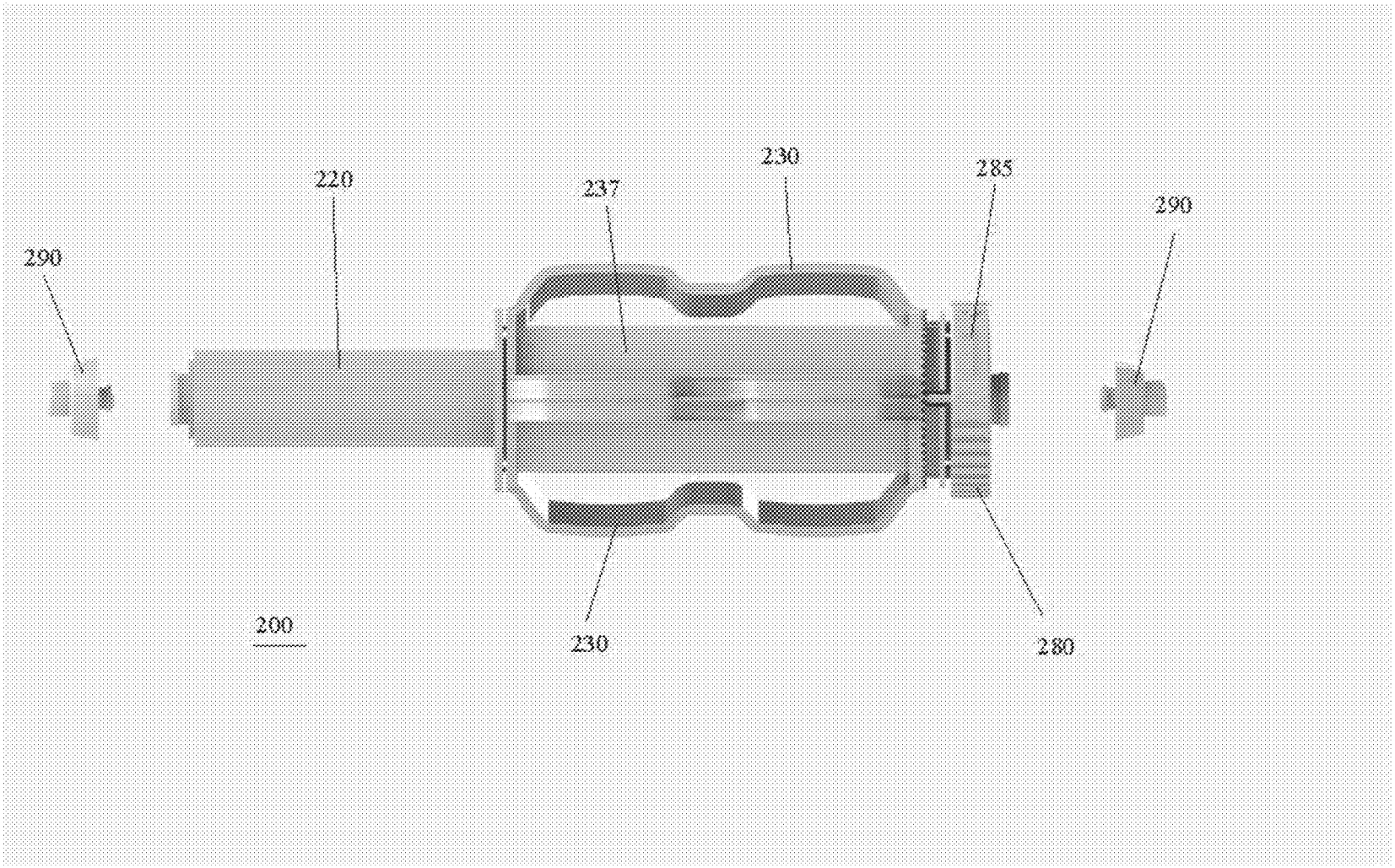

The compression of the spring located inside the spring housing creates an outward tension, which keeps the paper holder attached to the opening in the side walls of the paper towel holder. A non-skid synthetic rubber or plastic cap 290, shown in FIGS. 35A-D is inserted on each end, as illustrated in FIGS. 27D and 27E. The plastic or rubber cap has an expandable inner part 292 that is inserted into and expands within the opening, to hold the cap in place. The outer part 294 has a smaller diameter and fits into an opening or a groove of a toilet paper dispensing system.

The adjustable tension control cap 210 of the present invention, with adjustable tension and spin control functionality, is designed to operate with the known components and dispensers, adding the feature of controlling the tension and rotational speed of the dispenser.

Furthermore, the adjustable tension control cap 210 is constructed to be retrofitted and installed with many existing paper roll dispensers, without having to purchase a new dispenser product.

The inner and outer structure of an end lock 240, in accordance with at least one embodiment of the present invention is shown in FIGS. 31A-C and FIGS. 32A-D. It utilizes multiple expanding plastic, metallic or rubber teeth 245, to expand within the inner circular opening of the end ring 233*a* of the tension grip 235. The outer part 247 of the end lock 240 is structured to accommodate the plastic, metallic or rubber teeth 273 of the spring base 270. The teeth 273 are constructed to attach to the outer part 247 of the end lock and hold together the end lock and the other components of the toilet paper dispenser with the spring base 270 and the tension adjustment dial 280 in accordance with at least one embodiment of the invention.

The inner and outer structure of a tension adjustment dial 280, according to at least one embodiment of the present invention, is shown in FIGS. 34A-D. The tension adjustment dial 280 has a ribbed outer surface 282, which may be rotationally engaged and moved by the user in one direction to increase the tension of the cap and slow down the rotational speed of the dispenser, and in the other direction to decrease the tension and speed up the rotational speed and dispensing of the rolled material. The dial 280 also has a threaded inner surface 284 that allows movement of the tension adjustment dial up and down the threaded shaft 275 of the spring base 270.

In accordance with at least one embodiment, the braking blades 271 extend in the longitudinal direction (up or down) when a rotational force is applied by a user through the rotation of a tension adjustment dial 280 of the tension control cap. The braking blades 271 extend longitudinally and frictionally engage a ribbed surface 238 on the end ring 233*a* of the tension grip 235. This connection creates and increases friction against the braking blades 271. In another embodiment, the braking blades 271 may extending laterally, instead of or in addition to the longitudinal movement, and may also increase friction against the inner or another surface of the tension grip 235.

The user may choose to rotate the tension adjustment dial 280 in a direction of the increased tension, as may be indicated on a dial display 285, or, alternatively, the dispenser may receive electromagnetic signal or other types of signals causing the tension adjustment dial 280 dial to move up or down on the threaded shaft 275 of the spring base 270 in order to increase the tension and decrease the dispensing speed. When a rotational force is applied by the user (or through an automated setting process) to the ribbed outer surface 282 of the tension adjustment dial 280 in a direction of the increased tension (as may be indicated on a dial display 285) the tension adjustment dial 280 moves longitudinally, along the threaded shaft 275 of the spring base 270.

As further illustrated in 32A-B and 34A-C, the upward movement of the tension adjustment dial 280 pushes upward the braking blades 271, each of which is either integrally connected to, or molded as a part of, the spring base at the corresponding attachment point 272. When the braking blades 271 are pushed upward by the upward movement of the tension adjustment dial 280, the blades 271 will come into frictional contact with the ribbed surface 238 on the circular ring 233*a* of the tension grip 235. The force of friction between the blades and the ribbed inner surface increases with the upward movement, and decreases with the downward movement, of the braking blades 271.

This causes the roll to be more tightly held in place by the dispenser, and also controls the spinning speed during the unraveling of the dispensed product. As discussed above, it also prevents the unnecessary waste of s rolled product due to excessive spinning and unraveling.

The rotation of the tension adjustment dial 280 in the opposite direction (as indicated on the dial display 285) decreases upward force onto the blades 217 by the adjustment dial 280 and decreases the force of friction between the blades 271 and the ribbed surface 238 on the circular ring 233*a* of the tension grip 235. The decrease in friction lowers the tension with which the roll is held in place and also increases the rotation speed of the dispenser, allowing the user to set the dispenser to dispense more rolled material (when it is desired by the user). Thus, by controlling the tension exerted by the braking blades against the ribbed surface of the tension grip the user can vary and adjust the tension and unraveling speed.

Among other mentioned benefits of an adjustable tension control cap of the present invention is allowing the user to adjust tension and rolling speed for dispensing rolls with different diameters and variances due to different level of tightness in different brands and different types of rolls. It also allows to adjust the tension and unraveling speed of the same roll, but at different stages of use.

As a result, the present invention prevents unnecessary waste of the rolled product due to excessive unraveling. It also translates into noticeable benefits to the environment (by utilizing the rolled materials in a more efficient manner) and also translates to cost savings for the individual consumer.

Moreover, it offers a simple tension adjustment mechanism that is both inexpensive and easy to install with the existing dispensers that the user may have already purchased. The use of the present invention on a wider scale also translates to cleaner public facilities.

In all cases it is understood that the above-described arrangements are merely illustrative of the many possible specific embodiments which represent applications of the present invention. Numerous and varied other arrangements can be readily devised in accordance with the principles of the present invention without departing from the spirit and the scope of the invention.

We claim:

1. In a dispenser, a device having a cap with a tension adjustment control comprising:

a rotor having a threaded portion on an inner bottom surface;

a spring base including a plurality of braking blades that come into frictional contact with a surface of a rotor upon rotation of the rotor and operation of the tension adjustment dial;

whereby reducing rotational speed of the dispenser.

2. The device of claim 1, further comprising a tension adjustment dial for controlling the extent of frictional contact of said plurality of braking blades with a ribbed inner part of the contacting rotor surface.

3. The device of claim 2, wherein the plurality of braking blades extend longitudinally to a plane of rotation of the rotor and increasing the frictional contact with a ribbed inner surface of the rotor in response to rotation of the tension adjustment dial.

4. The device of claim 2, wherein the plurality of braking blades extend laterally to a plane of rotation of the rotor and increasing the frictional contact with the inner surface of the rotor in response to rotation of the tension adjustment dial.

5. The device of claim 2, wherein the spring base has a threaded shaft that accommodates longitudinal movement of a tension adjustment dial.

6. The device of claim 2, wherein the tension adjustment dial is cylindrical in shape and has a threaded inner surface that allows movement of the tension adjustment dial in the longitudinal direction along the threaded shaft of a spring base and the corresponding longitudinal movement of the braking blades.

7. The device of claim 2, further comprising a limit cap having a generally tubular shape and a skirt extension from the tubular surface, said limit cap constructed to limit the longitudinal movement of the tension adjustment dial and a corresponding longitudinal movement of the braking blades.

8. The device of claim 2, further comprising a solid rod extending through a central opening of the rotor, a finial grip for holding one tip of the solid rod and a finial grip cover, covering the finial grip on one end.

9. The device of claim 8, further comprising a race top having a central opening for accommodating the solid rod and a plurality of cavities for accommodating a plurality of tension rod wires for holding a dispensed product.

10. The device of claim 8, further comprising a base shell fitting over a base cover, having a circular opening in the center, said base shell fitting over the base cover and the tension adjustment dial.

11. The device of claim 10, further comprising a weighted base part above or below the adjustment wheel, covered by the base shell.

12. The device of claim 1, wherein the plurality of braking blades come into frictional contact with the rotor surface in response to at least one electromagnetic signal.

13. The device of claim 1, wherein the plurality of braking blades are molded to an inner surface of the spring base.

14. The device of claim 1, wherein the rotor has a plurality of cavities on an upper surface of the rotor for accommodating a plurality of tension rod wires for holding a dispensed product.

15. A product dispensing device for comprising:

a rotor having a threaded portion on an inner bottom surface;

a spring base including a threaded shaft and a plurality of braking blades that come into frictional contact with a surface of the rotor upon rotation of the rotor;

a tension adjustment dial for controlling the extent of frictional contact of said plurality of braking blades with a ribbed inner part of the contacting rotor surface;

a limit cap having a generally tubular shape and constructed to limit the longitudinal movement of the tension adjustment dial and a corresponding movement of the braking blades;

a plurality of tension rod wires for holding a dispensed product;

a solid rod extending through a central opening of the rotor;

a finial grip for holding one tip of the solid rod; and a finial grip cover, covering the finial grip;

wherein the plurality of braking blades extend and increase the frictional contact with a surface of the rotor in response to rotation of the tension adjustment dial.

16. The device of claim 15, further comprising a race top having a central opening for accommodating the solid rod and having a plurality of cavities for accommodating the tension rod wires.

17. The device of claim 16, further comprising:

a base shell fitting over a base cover, having a circular opening in the center, and fitting over the tension adjustment dial; and a weighted base part above or below the tension adjustment wheel, covered by the base shell.

18. The device of claim 15, wherein the increase in the frictional contact of the braking blades with the inner surface of the rotor causes slowing down of a speed of rotation of the rotor and dispensing of a product.

19. The device of claim 15, wherein the plurality of braking blades come into frictional contact with the rotor surface in response to at least one electromagnetic signal.

20. A rolled paper dispenser with an adjustable tension cap comprising:

a tension grip having a plurality of ribs and a spring housing for accommodating a tension spring within the housing;

a first and second circular end rings on the two end tips of the tension grip;

a tension rod attached to the first circular end;

a spring base having a threaded shaft;

a tension adjustment dial, having a ribbed outer surface; and a plurality of braking blades, extending in a longitudinal direction to the plane of the tension adjustment dial and coming into frictional contact with an inner surface of the tension grip, for controlling the rotational speed of the dispenser.

21. The dispenser of claim 20, wherein the plurality of braking blades extend longitudinally to the plane of tension adjustment dial, and increasing the frictional contact with the inner surface of the tension grip in response to rotation of the tension adjustment dial and a movement of the tension adjustment dial along the threaded shaft of the spring base.

22. The dispenser of claim 20, further comprising a dial display for the tension adjustment dial;

an end lock for fixedly attaching to the spring base; and a pair of plastic caps, having a flexible and expandable inner part for fixedly covering the tip of the tension rod on one end and the end lock on the other end.

* * * * *